US006880951B2

(12) United States Patent
Yoon

(10) Patent No.: US 6,880,951 B2
(45) Date of Patent: Apr. 19, 2005

(54) FLASHLIGHT USING A LIGHT EMITTING DIODE AS A LAMP

(75) Inventor: Sang-Yeon Yoon, Busan Metro (KR)

(73) Assignee: Altec Co., Ltd. (KR)

( * ) Notice: Subject to any disclaimer, the term of this patent is extended or adjusted under 35 U.S.C. 154(b) by 75 days.

(21) Appl. No.: 10/404,415

(22) Filed: Mar. 31, 2003

(65) Prior Publication Data

US 2003/0189826 A1 Oct. 9, 2003

(30) Foreign Application Priority Data

Apr. 4, 2002 (KR) ..... 20-2002-0010255
Nov. 12, 2002 (KR) ..... 2002-33814

(51) Int. Cl.[7] ..... F21L 4/00
(52) U.S. Cl. ..... 362/206; 362/202; 362/205
(58) Field of Search ..... 362/202, 205, 362/206, 294, 373

(56) References Cited

U.S. PATENT DOCUMENTS

| | | | | | |
|---|---|---|---|---|---|
| 4,228,484 | A | * | 10/1980 | Johnstone | 362/184 |
| 4,907,141 | A | * | 3/1990 | Wang | 362/205 |
| 5,629,105 | A | * | 5/1997 | Matthews | 429/97 |
| 5,975,714 | A | * | 11/1999 | Vetorino et al. | 362/192 |
| 6,296,367 | B1 | * | 10/2001 | Parsons et al. | 362/183 |
| 6,398,383 | B1 | * | 6/2002 | Huang | 362/202 |
| 2002/0109987 | A1 | * | 8/2002 | Lai | 362/206 |
| 2004/0114393 | A1 | * | 6/2004 | Galli | 362/555 |
| 2004/0212991 | A1 | * | 10/2004 | Galli | 362/157 |
| 2004/0223342 | A1 | * | 11/2004 | Klipstein et al. | 362/555 |

FOREIGN PATENT DOCUMENTS

| | | |
|---|---|---|
| WO | 00/24062 | 4/2000 |
| WO | 01/51847 | 7/2001 |
| WO | 02/052656 | 7/2002 |

OTHER PUBLICATIONS

International Search Report of International Application No. PCT/EP00/12918.

* cited by examiner

*Primary Examiner*—Thomas M. Sember
(74) *Attorney, Agent, or Firm*—Cantor Colburn LLP

(57) ABSTRACT

Disclosed is an LED flashlight using a high-luminance LED as a lamp. The LED flashlight has a conductive barrel, a conductive tail cap, and a head section. The head section includes a conductive head cap, an insulation case, a lamp module, first and second connecting conductors and a collimator lens. The conductive head cap is detachably coupled to a front end of the conductive barrel and has a transparent window. A front end of the insulation case is inserted into the head cap towards the transparent window. A slot is formed at an outer wall of the insulation case. The lamp module is assembled into an inner rear end of the insulation case and has an insulating substrate including an LED. An anode and a cathode electrode of the LED are formed at a peripheral portion of the lamp module. The lamp module has an insulating substrate formed at a rear surface thereof with a metal layer connected to a positive electrode of a battery. The first connecting connector has a U-shape and is inserted to peripheral portion of the insulating substrate. A first end of the second connecting connector is installed in the slot of the insulation case and a second end of the second connecting connector extends into the insulating case. The collimator lens assembled into the insulation case between the transparent window and the insulation substrate.

19 Claims, 24 Drawing Sheets

FLASHLIGHT USING A LIGHT EMITTING DIODE AS A LAMP

CROSS-REFERENCE TO RELATED APPLICATIONS

This application relies for priority upon Korean Utility Model Application Nos. 2002-10255 filed on Apr. 4, 2002 and 2002-33814 filed on Nov. 12, 2002, and the contents of which are herein incorporated by reference in its entirety.

BACKGROUND OF THE INVENTION

1. Field of the Invention

The present invention relates to a flashlight using a light emitting diode (hereinafter, referred to as LED) as a lamp (hereinafter, referred to as LED flashlight), and more particularly to an LED flashlight having an improved LED lamp module.

2. Description of the Related Art

Recently, as a semiconductor technology makes great strides, high-luminance LED devices and flashlights using the high-luminance LED devices as a lamp have been variously developed and produced on a commercial scale.

Generally, the LED has a life span about 100,000 hours, which is remarkably longer than the life span of a filament bulb or a discharging lamp, to thereby allow the LED to be semi-permanently used. In addition, since the LED is operated with very low power, the LED can keep longer that the filament bulb.

Generally, the LED flashlight may use one LED or a plurality of LED. According to a conventional structure of the LED flashlight using one LED, lead wires of the LED are inserted into a lamp holder and extended rearwards. Then, the extended lead wires are bent and electrically connected to a positive or a negative electrode of a battery by a switching operation. However, the conventional LED flashlight requires a great number of parts for connecting the electrodes and the lead wires, so an assembling process thereof is very complicated.

According to a conventional structure of the LED flashlight using a plurality of LED, the LEDs are used as a lamp of a head flash. The head flash radiates a white-light by combining red, yellow, and blue LEDs.

Since forward voltage and current of the LED generally drop as a temperature of a junction part of the LED is increased, a luminance of the LED is lowered as the temperature increases. Intensity of current passing through high-luminance LEDs is higher than intensity of current passing through conventional LEDs, so heat is generated when using the high-luminance LEDs for a long time. Therefore, an ambient temperature of the high-luminance LEDs is increased together with the temperature of the junction part due to the heat, so luminance of the high-luminance LEDs is gradually lowered.

In addition, since the LED used as a lamp of the flashlight is installed in a closed space of a head section of the flashlight and is shielded from external air, the ambient temperature of the LED is rapidly increased due to a thermal resistance of the LED.

In extreme cases, the characteristic of the LED is varied due to thermal stress applied to the LED, thereby shortening the life span of the LED and causing a trouble of the LED.

Therefore, a usage data book of the LED recommends a user to use the LED below maximum rated voltage and maximum rated current thereof. However, in case that the LED is installed in the closed space of the head section of the flashlight, heat generated from the LED still remains as a problem.

In addition, even if the LED is operated below maximum rated voltage and maximum rated current thereof, driving voltage of the LED is limited below rated voltage in use so luminance of the flashlight is limited below a predetermined level.

Accordingly, dealing of heat generated from the LED is seriously considered when designing the flashlight using the LED as a lamp to achieve uniform luminance even if the flashlight is used for a long time.

SUMMARY OF THE INVENTION

The present invention has been made to solve the above problems of prior arts, therefore, it is a first object of the present invention to provide an LED flashlight capable of improving directionality of light such that light generated from the LED flashlight flashes over a long distance by installing an LED and a collimator lens in a head section as a module and capable of facilitating an assembling work thereof by reducing the number of parts thereof.

A second object to the present invention is to provide an LED flashlight capable of effectively discharging heat generated from an LED module to an exterior, thereby maintaining uniform luminance regardless of a limitation of rated current even if the LED flashlight has been used for a long time.

A third object of the present invention is to provide a flashlight having a rear push button switch.

A fourth object of the present invention is to provide a flashlight having a battery holder therein.

A fifth object of the present invention is to provide a multi-LED flashlight capable of facilitating an assembling work thereof by reducing the number of parts through assembling a plurality of LEDs in one insulating substrate.

To achieve the above objects, the present invention includes a conductive barrel, a tail cap, and a head section.

According to an exemplary embodiment of the present invention, an LED flashlight is provided which comprises a conductive barrel, a tail cap, and a head section. The head section includes a conductive head cap, an insulation case, a lamp module, a first and a second connecting conductor, and a collimator lens.

The conductive head cap is detachably coupled to a front end of the conductive barrel and has a transparent window for radiating a light on a front surface thereof. The insulation case has a front end and a slot. The front end is inserted into the conductive head cap from a rear end of the conductive head cap towards the transparent window, and the slot is formed at an outer wall thereof and extends lengthwise the insulation case. The lamp module is assembled into an inner rear end of the insulation case and has an LED at a front center portion thereof. An anode and a cathode electrode terminal of the LED are arranged at a peripheral portion thereof. A metal layer is connected to a positive electrode of the battery and is coated on a rear surface thereof for discharging heat. The first connecting conductor is formed into an U-shape and is inserted to a peripheral portion of the insulating substrate in order to electrically connect the anode electrode to the metal layer. The second connecting conductor has a first end and a second end opposite to the first end. The first end is installed in the slot of the insulation case so as to electrically come into contact with an inner portion of the conductive head cap, and the second end extends into the insulation case, to thereby be connected with the cathode electrode terminal of the lamp module. The collimator lens is assembled into an inner portion of the insulation case between the transparent window and the insulating substrate in order to forwardly refract light radiated from the LED.

The head section also has a metal cap attached to the metal layer by interposing an insulating adhesive having high thermal conductivity and electric insulation characteristic. The metal cap comes into contact with the inner portion of the conductive barrel, to thereby discharge heat to an exterior by transferring heat from the metal layer to the conductive barrel.

The metal cap has a perforation hole formed at a center thereof for bringing the plus electrode of the battery into contact with the metal layer. The metal cap further includes an insulation ring inserted into the perforation hole so as to prevent the positive electrode of the battery from making contact with the metal cap through the perforation hole. The metal cap surrounds a rear end of the insulation case, and a front end of the metal cap makes contact with the rear end of the conductive head cap.

A length of the conductive barrel is identical to or longer than a width of an adult's palm. A plurality of protrusions are formed at an outer surface of the conductive barrel in order to provide a finger-massage effect to a user. The protrusions formed at the outer surface of the conductive barrel enlarges a surface area, so that the heat generated in the conductive barrel is rapidly discharged to the exterior, thereby improving a heat discharging efficiency. The first end of the second connecting conductor has an elastic structure so as to surely make contact with the inner portion of the conductive head cap.

The conductive tail cap preferably includes a push button switch. The push button switch includes a push button, a moving member, a conductive member, and a conductive rod. The push button is inserted into a hole inserted at a rear surface of a tail cap body in such a manner that the push button moves forwards when pressure is applied and returns to an initial position by elastic force of a spring when pressure is released. The moving member is inserted into the hole of the tail cap body in such a manner that the moving member is selectively toggled in an advanced state or in a moving-back state according as the moving member is pushed corresponding to a pushing operation of the push button. The conductive member has a perforation hole at a center thereof and electrically makes contact with the tail cap body. The conductive member limits the moving member to move within the hole. The conductive rod is coupled to the moving member through the perforation hole of the conductive member and moves forward and backward together with the moving member, so that the conductive rod makes the conductive member electrically contact with the minus electrode of the battery accommodated in the conductive barrel in moving forward, and breaks the conductive member electrically contact with the minus electrode of the battery in moving backward.

The flashlight includes a battery holder accommodated in the conductive barrel. The battery holder receives three AAA-type batteries in a row, and the three AAA-type batteries are electrically connected to each other in series. The battery holder includes a body for detachably holding a plurality of batteries in a row and for electrically connecting the batteries in series, a plus conductor formed at a front surface of the body and electrically making contact with the metal layer, and a minus conductor formed at a rear surface of the body and electrically making contact with the spring of the conductive tail cap.

The conductive barrel has a perforation hole formed at an outer sidewall of the front end and a push button switch installed in the conductive barrel. A knob of the push button switch is exposed to an exterior through the perforation hole, and an elastic member is installed in the perforation hole so as to cover the knob.

The push button switch includes a cylindrical insulation case, a spring, a plus conductor, and a switch. The cylindrical insulation case is accommodated in the conductive barrel and divided into two semi-cylindrical parts along an axial direction thereof. The spring is protruded from a front surface of the insulation case and fixed thereto, to thereby electrically make contact with the metal layer of the lamp module. The plus conductor is fixed to a rear surface of the insulation case, to thereby electrically make contact with the plus electrode of the battery. The switch is fixed to a lateral portion of the insulation case such that a knob is protruded through the perforation hole and has a first terminal electrically connected to a rear end of the spring and a second terminal electrically connected to the plus conductor for performing a switching action. The conductive barrel has a length longer than a length of three C-type batteries aligned in series.

According to another exemplary embodiment of the present invention, a multi-LED flashlight is provided which comprises a conductive barrel, a tail cap, a head case, a head cap, a lamp module and a reflective mirror.

The conductive barrel receives at least one battery therein and has a metallic cylindrical pipe structure so as to provide a path for electrically connecting a minus electrode of the battery to one terminal of the lamp. The conductive barrel has a curvature of a sine wave formed on an outer surface thereof. A wavelength of the curvature becomes longer as the wavelength reaches the head case to the tail cap. The curvature section is designed according to ergonomics, so the curvature section matches with the palm and fingers of the user when the user grips the conductive barrel. The conductive barrel may have a length longer than a length of three batteries aligned in series.

The tail cap is made of metal and is detachably screw-coupled to a rear end of the conductive barrel. The tail cap applies pressure to a minus electrode of the battery accommodated in the conductive barrel through a spring installed at a front surface of the tail cap. In addition, the tail cap electrically connects the conductive barrel to the minus electrode of the battery.

The head case is made of metal and has a rear end into which a front end of the conductive barrel is inserted and a front end having a diameter larger than a diameter of the rear end. The head case is screw-coupled with the front end of the conductive barrel, and moves along an axial direction of the conductive barrel in such a manner that the front end of the conductive barrel reaches a stopping jaw formed at an inner portion of the head case when the front end of the conductive barrel is screw-coupled into the head case. The head case may include a metal ring having high thermal conductivity. The metal ring is arranged between the stopping jaw and the insulating substrate, and closely couples the insulating substrate and the head case together, to thereby transfer heat to the head case from the insulating substrate through the metal ring. The head case includes a plurality of resistance devices radially arranged on the front surface of the insulating substrate. The resistance devices are electrically connected between a center electrode and each anode electrode of the high-luminance LEDs, to thereby limit driving current supplied from the battery to the high-luminance LEDs.

The head cap is detachably screw-coupled to the front end of the head case and has a transparent window formed at a front surface thereof through which a light is radiated.

The lamp module includes an insulating substrate, a plurality of high-luminance LEDs, a center terminal, and a ring terminal.

The insulating substrate is inserted into the head case and rested on the stopping jaw. The high-luminance LEDs are aligned on a front surface of the insulating substrate so as to forwardly radiate a light.

The center terminal is formed at a center of a rear surface of the insulating substrate to permit anode electrodes of the high-luminance LEDs to be commonly connected thereto and makes contact with a plus electrode of the battery.

The ring terminal is formed at a peripheral portion of the center terminal to permit cathode electrodes of the high-luminance LEDs to be commonly connected thereto and making contact with the front end of the conductive barrel.

The reflective mirror is installed in an internal space, which is defined by the head case and the head cap coupled to each other, in order to forwardly reflect light radiated from the LEDs.

The reflective mirror has a cup-shape and is formed at a bottom thereof with a plurality of perforation holes for receiving a plurality of LEDs therein. An inner surface of the reflective mirror is formed as a parabolic surface.

In addition, the reflective mirror can be formed in a cylindrical pipe shape, which is tapered towards a rear portion thereof. In this case, a plurality of LEDs are installed in the cylindrical pipe and a reflective layer is coated on the upper surface of the insulating substrate.

Three-thread structure may be provided at an inner portion of the head case and an outer front end of the conductive barrel to rapidly apply power on/off the flashlight.

The conductive barrel has a length longer than a length of three AA-batteries aligned in series. In addition, the inner diameter of the conductive barrel is slightly larger than a diameter of the AA-sized battery.

The tail cap includes a push button switch for controlling a distance between a spring and the minus electrode of the battery.

According to still another exemplary embodiment of the present invention, the flashlight includes a conductive barrel, a tail cap, a head cap, a lamp module, and a reflective mirror. The conductive barrel has a head section, a housing section and a locking jaw formed at a boundary between the head section and the housing section. The housing section receives at least one battery therein.

The tail cap detachably coupled to a rear end of the conductive barrel and has a push button. The push button electrically connects a minus electrode of the battery accommodated in the conductive barrel to the conductive barrel through a spring. The head cap is detachably coupled to the front end of the head case and has a transparent window formed at a front surface thereof through which light is radiated. The lamp module includes an insulating substrate inserted into the head case to be rested on the locking jaw, a plurality of LEDs aligned on a front surface of the insulating substrate so as to forwardly radiate light, a center terminal formed at a center of a rear surface of the insulating substrate to permit anode electrodes of the LEDs to be commonly connected thereto and slightly protruded in a rear direction thereof to make contact with a positive electrode of the battery, and a ring terminal formed at a peripheral portion of the center terminal provided on the rear surface of the insulating substrate to permit cathode electrodes of the LEDs to be commonly connected thereto and making contact with the locking jaw. The reflective mirror is installed in an internal space, which is defined by the head case and the head cap coupled to each other, in order to forwardly reflect light radiated from the high-luminance LEDs.

BRIEF DESCRIPTION OF THE DRAWINGS

The above objects and other advantages of the present invention will become more apparent by describing in detail preferred embodiments thereof with reference to the attached drawings in which:

FIG. 5B is a sectional view taken along the line A–A' of the LED flashlight shown in FIG. 1 when power is on;

FIG. 14 is a sectional view taken along the line A—A of the multi-LED flashlight shown in FIG. 11 when power is on;

DETAILED DESCRIPTION OF THE PREFERRED EMBODIMENTS

Hereinafter, the present invention will be described in detail with reference to accompanying drawings.

Embodiment 1

FIGS. 1 to 5 are views showing a rear push button type single LED flashlight according to a preferred embodiment of the present invention.

Figure 1:
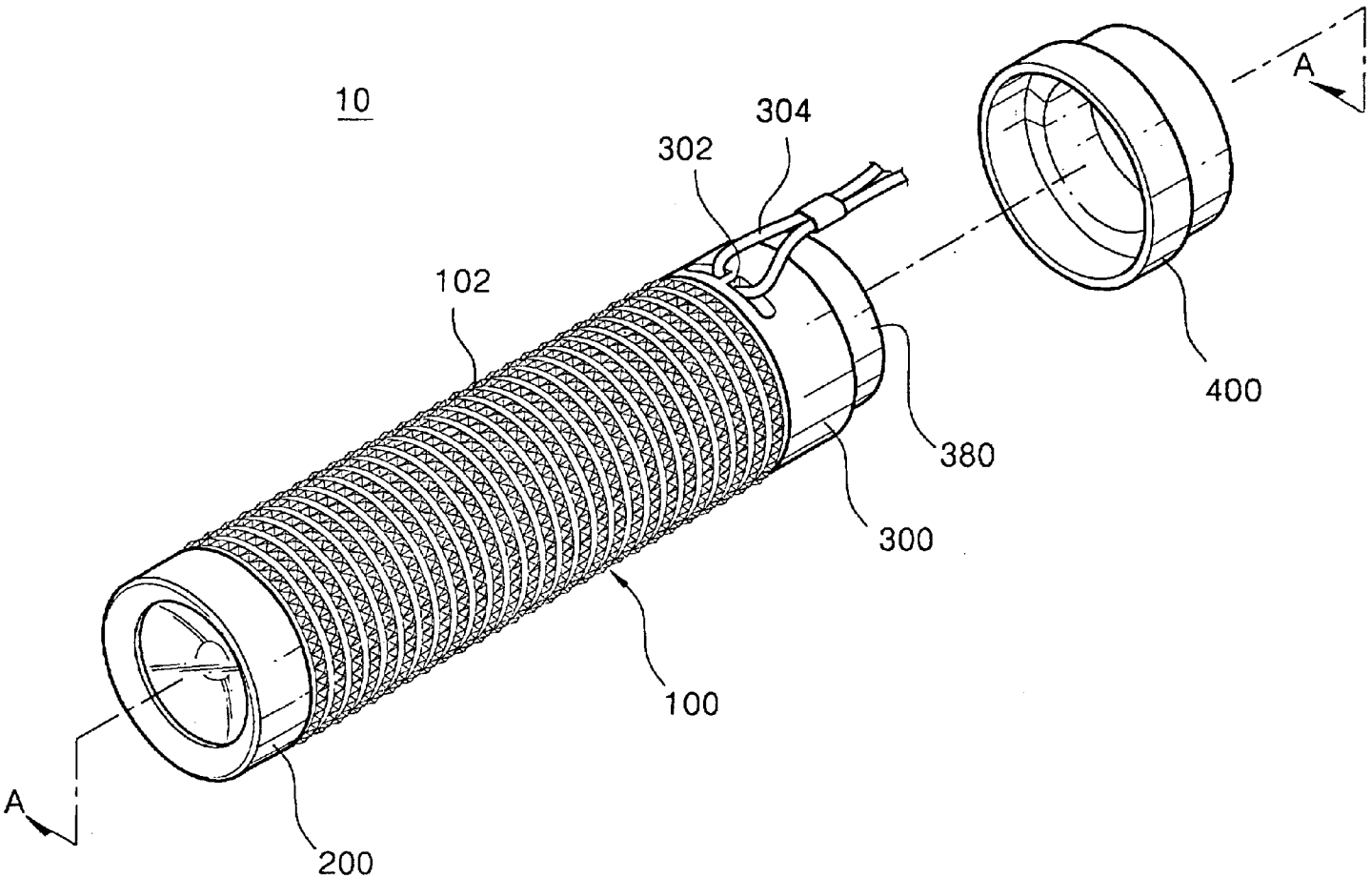
FIG. 1 is a schematic perspective view showing an LED flashlight according to one embodiment of the present invention.

Referring to FIG. 1, a flashlight 10 according to one embodiment of the present invention includes a conductive barrel 100, a head section 200, a tail cap 300 and a rubber cap 400.

The conductive barrel 100 has a length substantially identical to a width of a palm of an adult's hand. The conductive barrel 100 has a metallic cylindrical structure so as to provide a current path for electrically connecting a negative electrode 24 of a battery 20 to a terminal of a lamp.

An outer surface of the conductive barrel 100 is formed with a plurality of protrusions 102 so that a user feels a finger-massage effect when gripping the conductive barrel 100. In addition, the protrusions 102 enlarge a surface area of the conductive barrel 100 so that heat generated in the conductive barrel 100 is rapidly discharged out of an exterior. On the other hand, the protrusions 102 also prevent the flashlight from slipping down from the palm.

A female-thread 104 is formed at an inner front end of the conductive barrel 100, and a stopping jaw 106 is formed at a rear portion of the female-thread 104. A female-thread 108 is formed at an inner rear end of the conductive barrel 100 (referred to FIGS. 5A and 5B).

Figure 2:
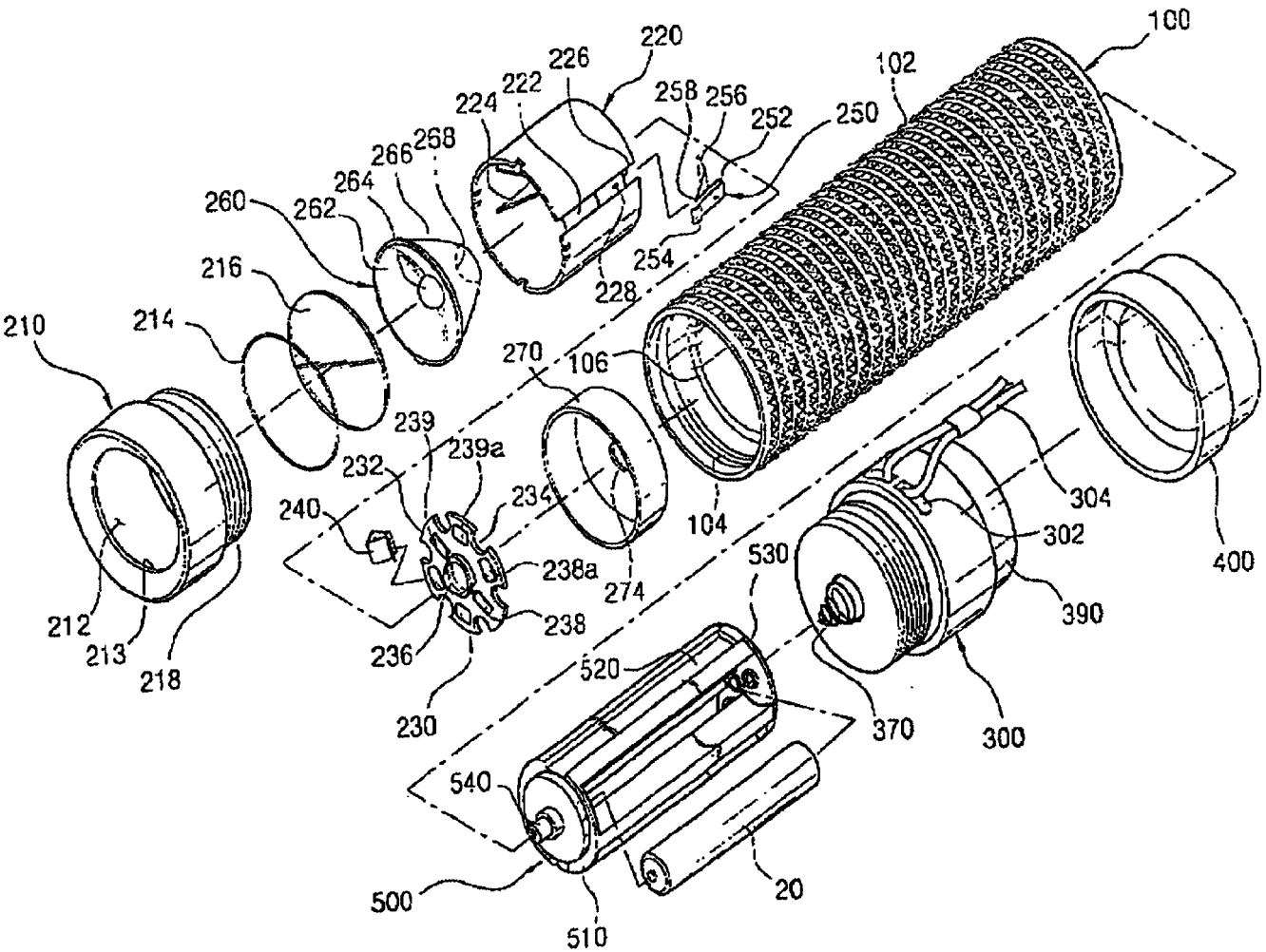
FIG. 2 is an exploded perspective view showing the LED flashlight shown in FIG. 1.

Referring to FIG. 2, the head section 200 includes a head cap 210, an insulation case 220, a lamp module 230, first and second connecting conductors 240 and 250, a lens 260 and a metal cap 270 for discharging heat.

The head cap 210 is formed at a center thereof with an opening 212 through which light is radiated. A locking protrusion 213 is formed around the opening 212. An O-ring 214 and a transparent lens 216 are sequentially installed from an inner portion of the locking protrusion 213, thereby forming a transparent window through which light is radiated.

A male-thread 218 is formed at an outer portion of a rear end of the head cap 210. The male-thread 218 is screw-coupled with the female-screw 104 of the conductive barrel 100. At this time, the transparent lens 216 is pressed between the locking protrusion 213 and a front end of the insulation case 220. Thus, the O-ring 214 seals between the locking protrusion 213 and the transparent lens 216.

The insulation case 220 is made of plastic and supports the lamp module 230, first and second connecting conductors 240 and 250, and the lens 260. The lamp module 230 is detachably coupled to an inner front portion of the insulation case 220.

A slot 222 is lengthwise formed at an outer wall of the insulation case 220. The second connecting conductor 250 is inserted into the slot 222 from a rear portion of the slot 222.

A plurality of supporting members 224 having right-angled triangle shapes are installed at an inner portion of the insulation case 220 in order to support a rear portion of the lens 260, while supporting a front portion of the lamp module 230.

The lamp module 230 adopts a Luxeon (a trade-name Lumileds Company of U.S.A) star structure. The star structure includes a metal layer 234 formed at a rear surface of a MCPCB 232 for discharging heat, a single LED 236 installed at a front center portion of the metal layer 234, and six terminals radially aligned around the single LED 236. A first terminal 238 is connected to an anode electrode of the LED 236, and a pair of first soldering electrodes 238*a* formed at both sides of the first terminal 238 are electrically connected to the first terminal 238. A second terminal 239 is connected to a cathode electrode of the LED 236, and a pair of second soldering electrodes 239*a* formed at both sides of the second terminal 239 are electrically connected to the second terminal 239.

The star structure easily discharges heat through spaces formed between radiating protrusions. The metal layer 234 includes an aluminum coating layer having superior thermal conductivity.

The first connecting conductor 240 has a substantially U-shaped structure and a lateral portion of the MCPCB 232 is inserted into the first connecting conductor 240 so that a soldering terminal 293*a* of the MCPCB 232 is electrically connected to the metal layer 234. Due to the first connecting conductor 240, the metal layer 234 is used as a heat sink or as a plus pad electrically connected to a plus terminal of a battery.

The second connecting conductor 250 includes a first end part 254 forwardly extending along an inner portion of the slot 222 from a first bending part 252, which is inserted into a rear end 226 of the slot 222 formed in the insulation case 220. The first end part 254 is bent such that the first end part 254 is protruded from an outer surface of the insulation case 220. That is, the first end part 254 has an elastic structure. The elastic structure of the first end part 254 ensures an electric contact when the first end part 254 makes contact with an inner portion of the head cap 210.

A second end part 256 forwardly extending along the inner portion of the insulation case 220 from the first bending part 252 is again backwardly bent, while forming a second bending part 258. Then, the second end part 256 slantingly extends in a central direction thereof so as to be soldered with the second soldering electrode 239*a*. The second bending part 258 also has an elastic structure in order to ensure a reliable electric contact with respect to the second soldering electrode 239*a* by allowing an end portion of the second end part 256 to elastically make contact with the second soldering electrode 239*a*.

The lens 260 includes a collimator lens. Examples of such collimator lens are disclosed in WO 00/24062, WO 01/51847 and WO 02/52656.

The collimator lens 260 is a modified convex lens capable of collecting light and forwardly radiating collected light. The collimator lens 260 includes a front surface, which is formed into a planar surface or a concave parabolic surface 262, a convex protrusion 264 formed at a center of the concave parabolic surface 262, a rear surface formed into a convex parabolic surface 266 and a slot 268 formed at a center of the convex parabolic surface 266. Thus, light laterally radiated from the slot 268 is totally reflected from the convex parabolic surface 266 so that light forwardly proceeds. In addition, due to an optical characteristic of the convex lens regarding the concave parabolic surface 262, light is axially focused while traveling straight. In addition, forwardly radiated light is axially focused while traveling straight due to a convex lens structure regarding the convex protrusion 264. Accordingly, light radiated from the LED 236 is forwardly focused and travels straight while passing through the collimator lens, thereby improving luminance of light.

The metal cap 270 is attached to the metal layer 234 formed at the rear surface of the MCPCB 232 by interposing an insulation member 272 having superior thermal conductivity (shown in FIG. 5A) therebetween. The metal cap 270 makes contact with an inner portion of the conductive barrel 100 so as to transfer heat from the metal layer 234 to the conductive barrel 100 such that heat is discharged to an exterior. That is, the metal cap 270 improves a heat discharging efficiency so that a temperature of a junction part of the LED is not excessively increased, thereby uniformly maintaining an optical characteristic of the LED even if the LED has been used for a long time. In addition, due to the superior heat discharging efficiency, current having intensity of hundreds of milli-amperes (mA) supplied from the battery is completely applied to the LED without any interruptions so that luminance of LED is maximized.

The insulation member 272 includes insulating adhesives or dual-sided insulating tapes having superior thermal conductivity and electric insulation characteristic. The insulating adhesives are thermally conductive insulating adhesives, which are commercially available.

The metal cap 270 is formed at a center thereof with a perforation hole 274 so as to allow the plus electrode of the battery to be connected to the metal layer. The metal cap 270 surrounds a rear end of the insulation case and a front end of the metal cap 270 makes contact with a rear end of the head cap 210.

Accordingly, after sequentially assembling the lens 260, the lamp module 230, and the first and second connecting conductors 240 and 250 into the insulation case 220, the metal cap 270 is attached to the rear surface of the lamp module 230 by applying insulating adhesives therebetween. At this time, the insulating adhesives are not applied to a predetermined portion of the metal layer 234, which is corresponding to the perforation hole 274 of the metal cap 270.

Then, the insulation case 220 is inserted into the head cap 210 from a rear portion of the head cap 210. Thus, the insulation case 220 is completely surrounded by the head cap 210 and the metal cap 270, so the insulation case 220 is not visible from the exterior.

The head section 200 having the above structure is screw-coupled into a front end of the conductive barrel 100. At this time, a rear edge portion of the metal cap 270 is rested on the stopping jaw 106 of the conductive barrel 100, and a lateral portion of the metal cap 270 is transition-fitted into the conductive barrel 100. Accordingly, the metal cap 270 makes thermal-communication with respect to the conductive barrel 100.

Referring to FIG. 1, the tail cap 300 is provided at a rear portion thereof with a push button 390, which is covered with the rubber cap 400. In addition, the tail cap 300 is formed at a side thereof with connection holes 302, into which a string 304 is coupled.

Figure 3:
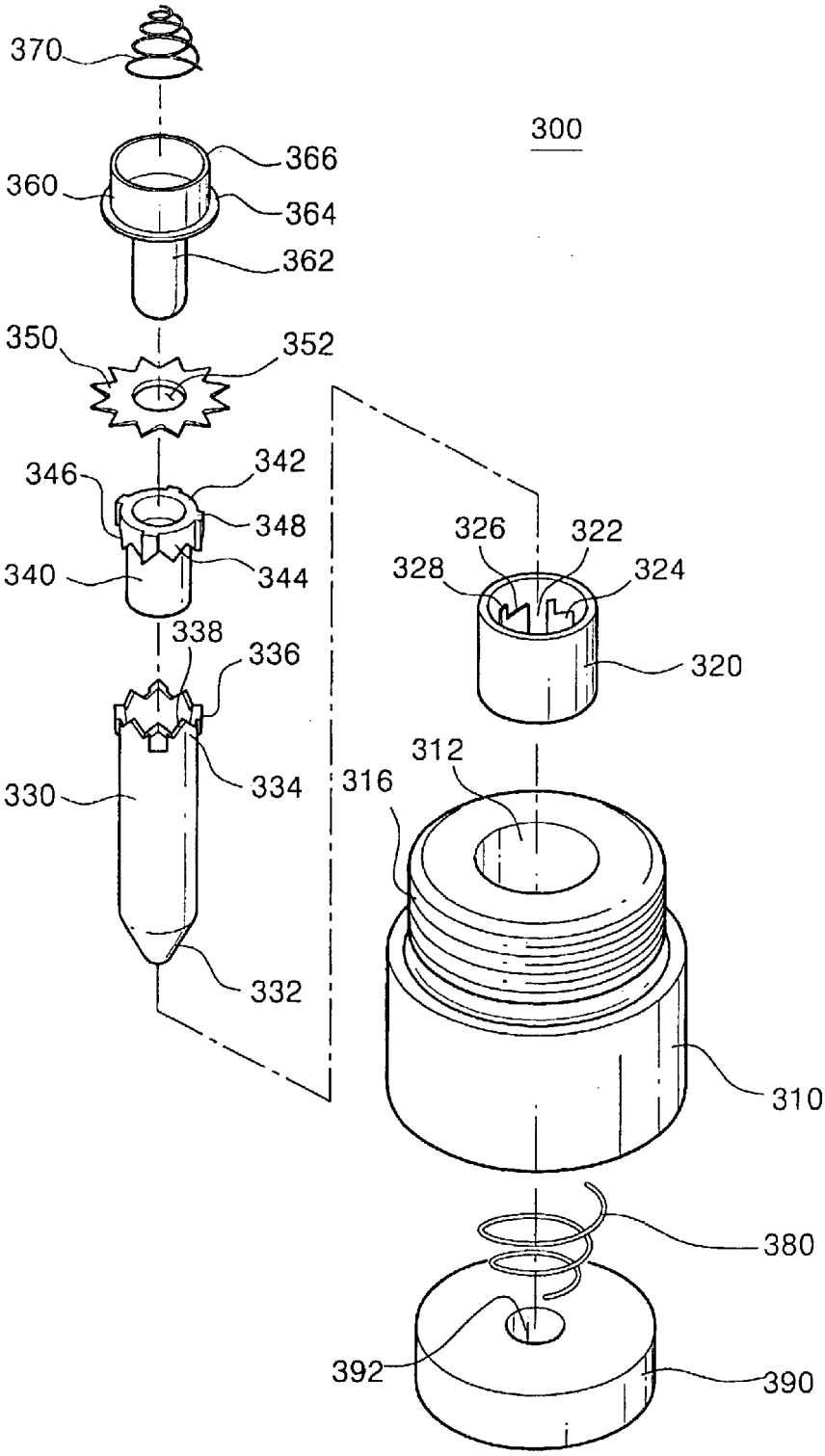
FIG. 3 is an exploded perspective view showing a tail cap shown in FIG. 2.

Referring to FIG. 3, the tail cap 300 includes a body 310, an outer tub 320, a middle tub 330, an inner tub 340, a conductive member 350, a conductive rod 360, first and second springs 370 and 380, and the push button 390.

The body 310 has a cylindrical shape and is formed at a center thereof with a hole 312. A small perforation hole 314 having a diameter smaller than a diameter of the hole 312 is formed at a bottom of the hole 312. A male-thread 316 is formed at an outer surface of a front end of the body 310. The male thread 316 is screw-coupled with the female-thread 108 formed at the rear end of the conductive barrel 100. The body 310 is formed at a bottom portion thereof with a recess 318. The recess 318 is communicated with the hole 312 through the perforation hole 314.

The outer tub 320 is made of plastic and formed at an inner sidewall thereof with guide slots 322. A saw-tooth section having first and second slope surfaces 326 and 328 is formed at front ends of protrusions 324, which are positioned between the guide slots 322.

The middle tub 330 is accommodated in the outer tub 320. A rear end 332 of the middle tub 330 extends to a space defined by the recess 318. Guide protrusions 336, which are slidably moved forwards or backwards along the guide slots 322 of the outer tub 320, are formed at an outer wall of the front end 334 of the middle tub 330.

The inner tub 340 is accommodated in the middle tub 330. A brim part 344 is formed at a front end 342 of the inner tub 340. A saw-tooth section 346 meshed with the saw-tooth section 338 of the middle tub 334 is formed at a lower portion of the brim part 344. In addition, a guide protrusion 348 is formed at an outer wall of the brim part 344. The guide protrusion 348 is offset from the guide protrusion 336 by a half-pitch when the saw-tooth section 338 is meshed with the saw-tooth section 346. Accordingly, the inner tub 340 is also moved forwards or backwards along the guide slot 322 of the outer tub 320.

The conductive member 350 is made of metal and has a star-like shape. A hole 352 is formed at a center of the conductive member 350. The conductive member 350 fixes a tub assembly including the outer, middle and inner tubes in the hole 312 of the body 310, while performing a function of an electric conductor. The conductive member 350 is press-fitted into the hole 312 so as to electrically make contact with the body 310.

The conductive rod 360 is a metal rod. A rear end 362 of the conductive rod 360 is press-fitted into the inner tub 340 through the hole 352 of the conductive member 312, so that the conductive rod 340 moves forwards or backwards together with the inner tub 340. The conductive rod 360 is formed at a front end 364 thereof with an annular loop 366, to which a rear end of a first spring 370 is securely fixed while making an electric connection.

A front end of the first spring 370 intermittently makes contact with a negative electrode of the battery.

A second spring 380 is inserted into an outer portion of the rear end 332 of the middle tub 330 extending to the recess 318.

The push button 390 has a disc shape and is formed at a center thereof with a hole 392. The rear end 332 of the middle tub 330 is securely fixed into the hole 392. The push button 390 is moved forwards and backwards within the recess 318 together with the middle tub 330.

Figure 4:
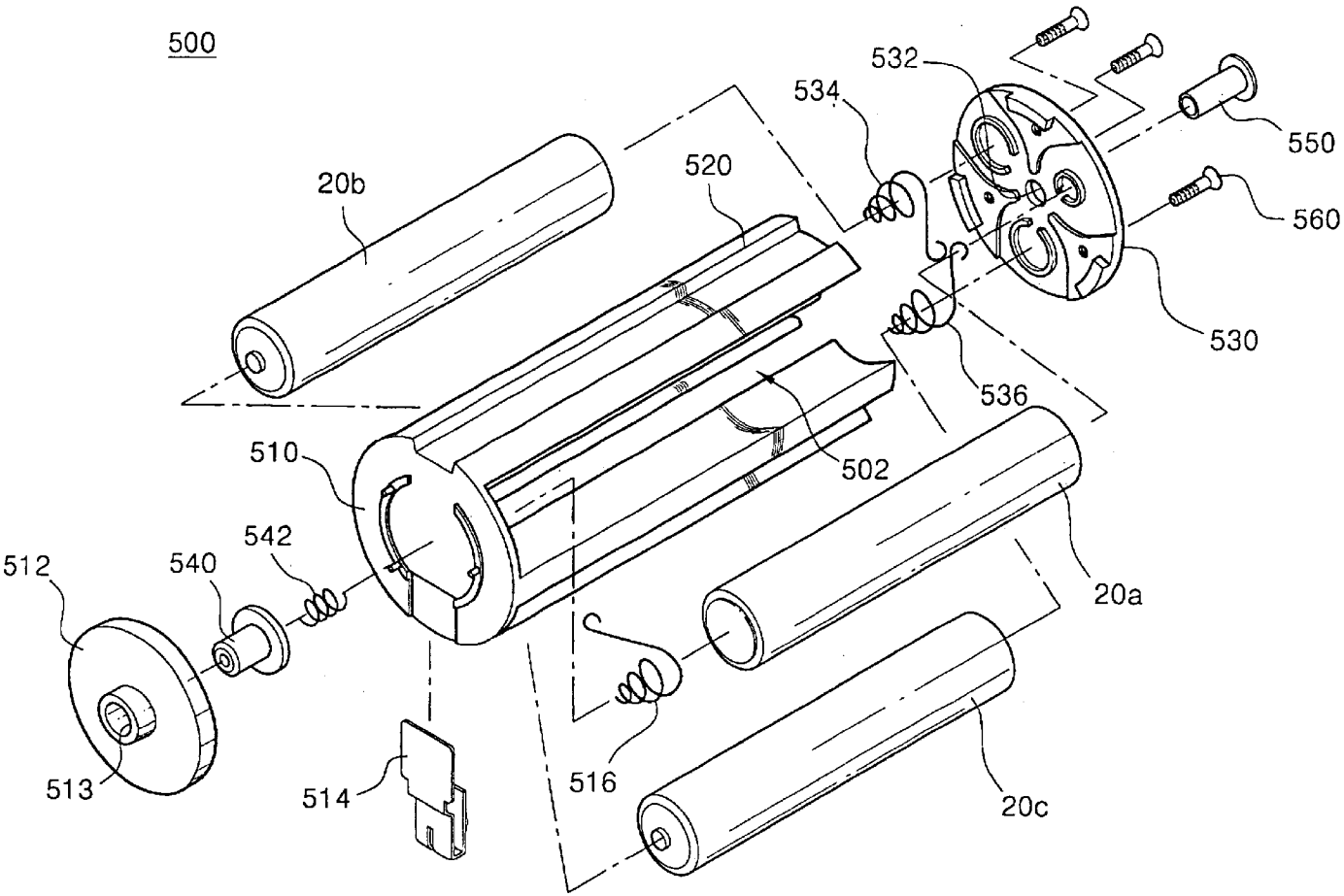
FIG. 4 is an exploded perspective view showing a battery cartridge shown in FIG. 2.

Referring to FIG. 4, a battery or a cartridge 500 has a cylindrical structure having a length longer than a length of AAA-type batteries 20*a*, 20*b* and 20*c* and a diameter, which is more than twice a diameter of AAA-type batteries 20*a*, 20*b* and 20*c*, so as to receive batteries 20*a*, 20*b* and 20*c* therein in series. Three elongated opening sections 502 are formed at an outer wall of the cylindrical structure in order to receive the batteries therein.

The cartridge 500 mainly includes a front plate 510, supporting members 520, a rear plate 530, a plus conductor 540, and a minus conductor 550.

Three supporting members 530 are integrally formed with the front plate 510 and backwardly extend from a rear surface of the front plate 510. The rear plate 530 is coupled to a free end of the supporting members 520 by means of a screw 560.

An insulation cap 512 formed at a center thereof with a perforation hole 513 is coupled to a front surface of the front plate 510. A U-shaped connecting conductor 514 is inserted into the front plate 510 from a lateral portion of the front plate 510.

A rod-shaped conductor 540 is electrically connected to the cartridge 500 through a spring 542. A rear end of the spring 542 is inserted into a front surface of the connecting conductor 514. The rod-shaped conductor 540 is installed on the front plate 510 in such a manner that a front end of the rod-shaped conductor 540 is protruded through a hole 513 of the insulation cap 512. The rod-shaped conductor 540 is flexibly moved in forward and backward directions by means of the spring 542.

A spring 516 is installed at the rear surface of the front plate 510. One end of the spring 517 makes contact with a minus electrode of a battery 20*a*, and the other end of the spring 517 extends in a direction vertical to a compression direction of the spring so as to make contact with a plus electrode of an adjacent battery 20*b*.

A perforation hole 532 is formed at a center of the rear plate 530. A sleeve conductor 550 is inserted into the perforation hole 532. A front end of the sleeve conductor 550 is expanded radially outward such that the front end of the sleeve conductor 550 can be fixed to an edge of the perforation hole 532 of the rear plate 530. Springs 534 and 536 are installed at the front surface of the rear plate 530. One end of the spring 534 makes contact with the minus electrode of the battery 20*b*, and the other end of the spring 534 is electrically connected to the front end of the sleeve conductor 550. One end of the spring 536 makes contact with the minus electrode of the battery 20*c*, and the other end of the spring 536 makes contact with the plus electrode of the battery 20*a*. The plus electrode of the battery 20000*c* makes contact with the other end of a connecting connector 514.

Accordingly, the batteries 20*a*, 20*b* and 20*c* are aligned between the rod-shaped conductor 540 and the sleeve conductor 550 and connected to each other in series.

In addition, the batteries 20*a*, 20*b* and 20*c* are inserted into openings 502 formed between three supporting members 520 and arranged in a row.

The battery cartridge 500 is accommodated in the conductive barrel 100. The front end of the rod-shaped conductor 540 electrically makes contact with the metal layer 234 exposed to the perforation hole 274 formed at the center of the metal cap 270. The rear end of the sleeve conductor 550 intermittently makes contact with the spring 370 of the tail cap 300.

Figure 5A:
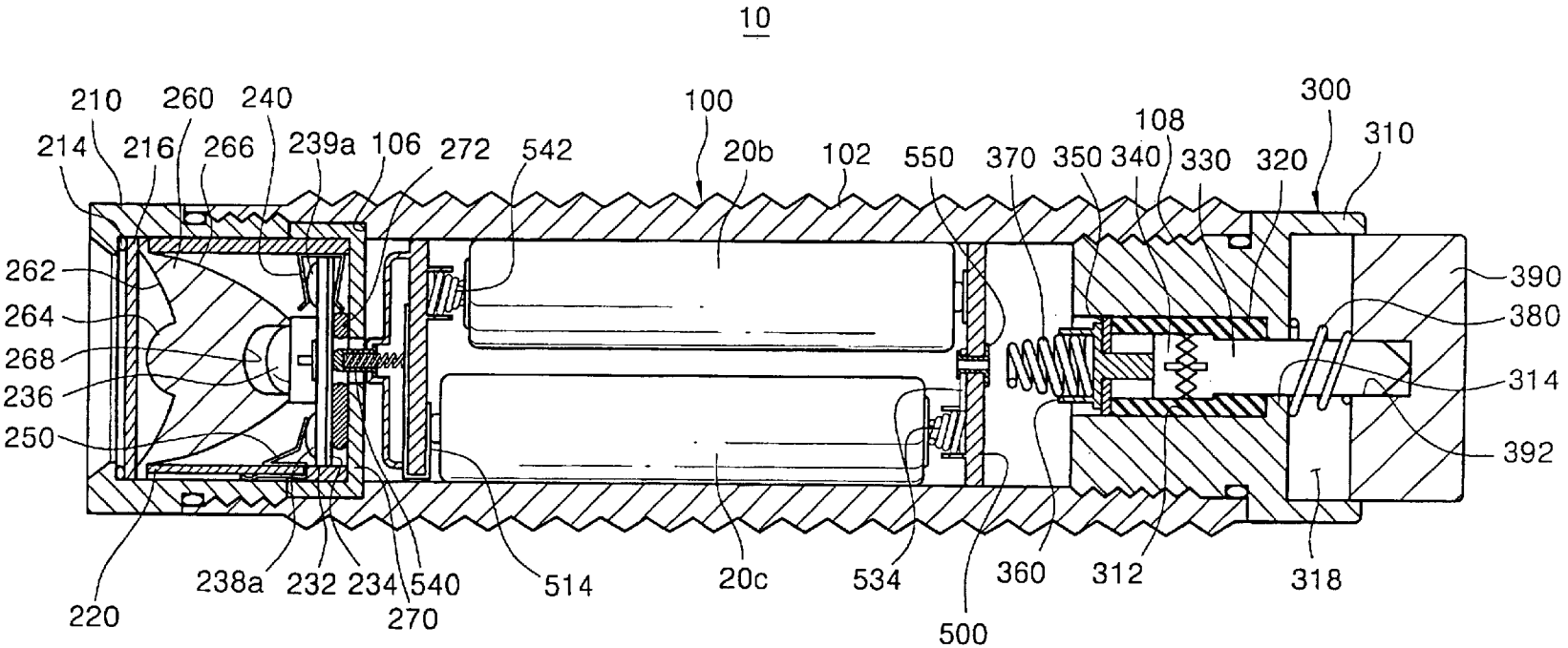
FIG. 5A is a sectional view taken along the line A–A' of the LED flashlight shown in FIG. 1 when power is off.
Figure 5B:
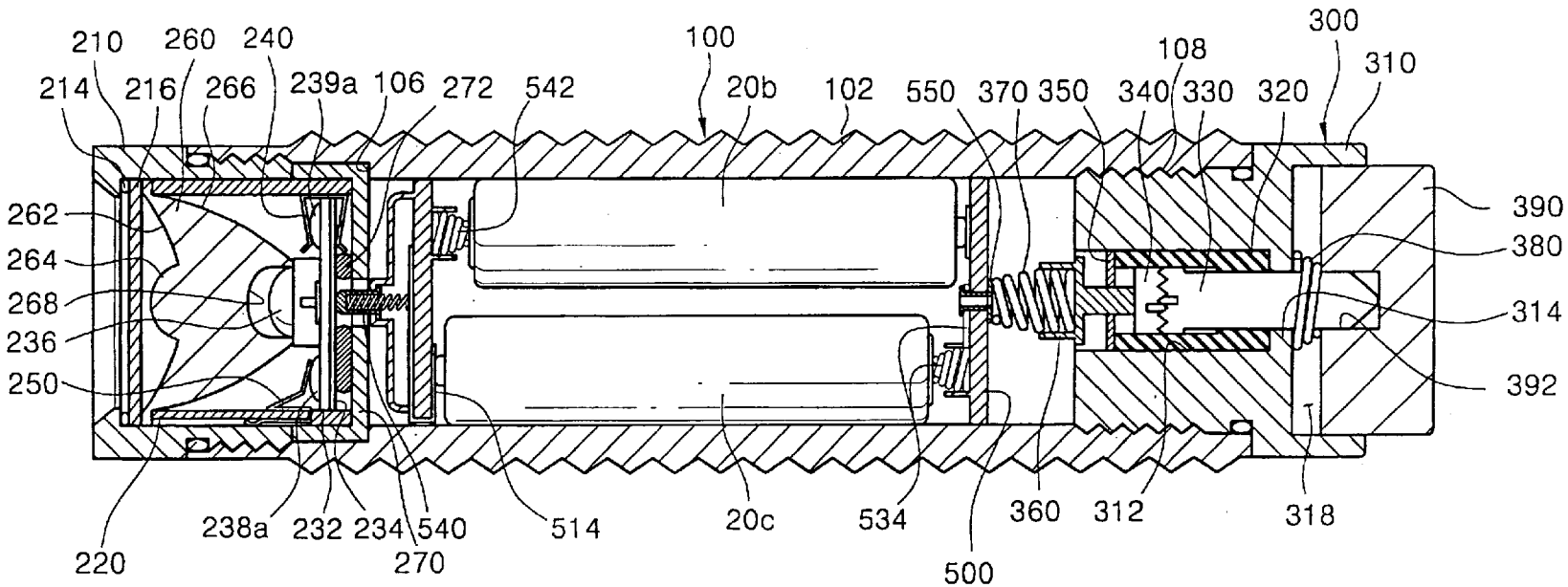

Hereinafter, an on/off operation of power will be described with reference to FIGS. 5A and 5B.

When pushing the push button 390, the middle tub 330 forwardly moves along the guide slot 222 formed in the outer tub 320. At this time, the inner tub 340 also moves together with the outer tub 320. When the guide protrusion 348 formed at an outer wall of the inner tub 340 obviates the guide slot 322, the inner tub 340 is turned to the right by a half-pitch along the first slope surface 326 of the saw-tooth section of the outer tub 320 due to elastic force of the spring 370, so that the inner tub 340 is meshed with the middle tub 330. When releasing power from the middle tub 330, the middle tub 330 and the push button 390 moves backwards due to restoring force of the second spring 380. At this time, since the guide protrusion 348 of the inner tub 340 is turned to the right by a half-pitch, the inner tub 340 is further turned to the right by a half-pitch along the first slope surface 326 so that the inner tub 340 is turned to the right by one-pitch. Thus, the inner tub 340 stably maintains an advanced state (power-on state) without moving backwards. At this time, the conductive rod 360 is slightly offset from an initial position thereof due to elastic force of the first spring 370, so that the conductive rod 360 electrically makes contact with the conductive member 350.

When pushing the push button 390 again, the middle tub 300 forwardly moves so that the inner tub 340 moves beyond a top of the second slope surface 328. Thus, the inner tub 340 is turned to the right by a half-pitch while being moved backwards, so that the inner tub 340 is meshed with the saw-tooth section of the middle tub 330.

When the middle tub 330 is returned to an initial position thereof, the guide protrusion 348 is turned to the right by a half-pitch along the second slope surface 328 so that the guide protrusion 348 is inserted into the guide slot 322 while being moved backwards by elastic force of the first spring 370. Thus, the first spring 370 is remote from the sleeve conductor 550 of the battery cartridge 500. Therefore, the inner tub 340 stably maintains a moving-back state (power-off state).

Figure 6:
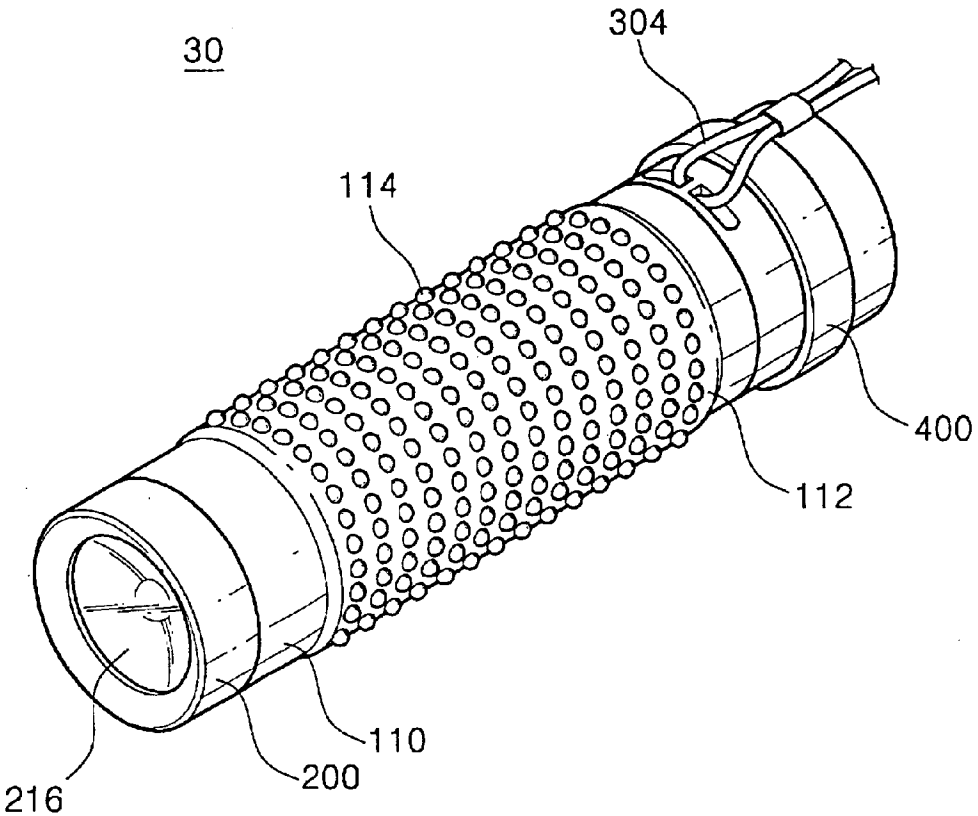
FIG. 6 is a perspective view of an LED flashlight modified from the LED flashlight according to one embodiment of the present invention.

FIG. 6 is a perspective view of an LED flashlight 30 according to another embodiment of the present invention. According to the present embodiment, the LED flashlight 30 includes a conductive barrel 110 having an elastic skin 112, such as a rubber pipe, formed with a plurality of embossing protrusions 114.

Figure 7:
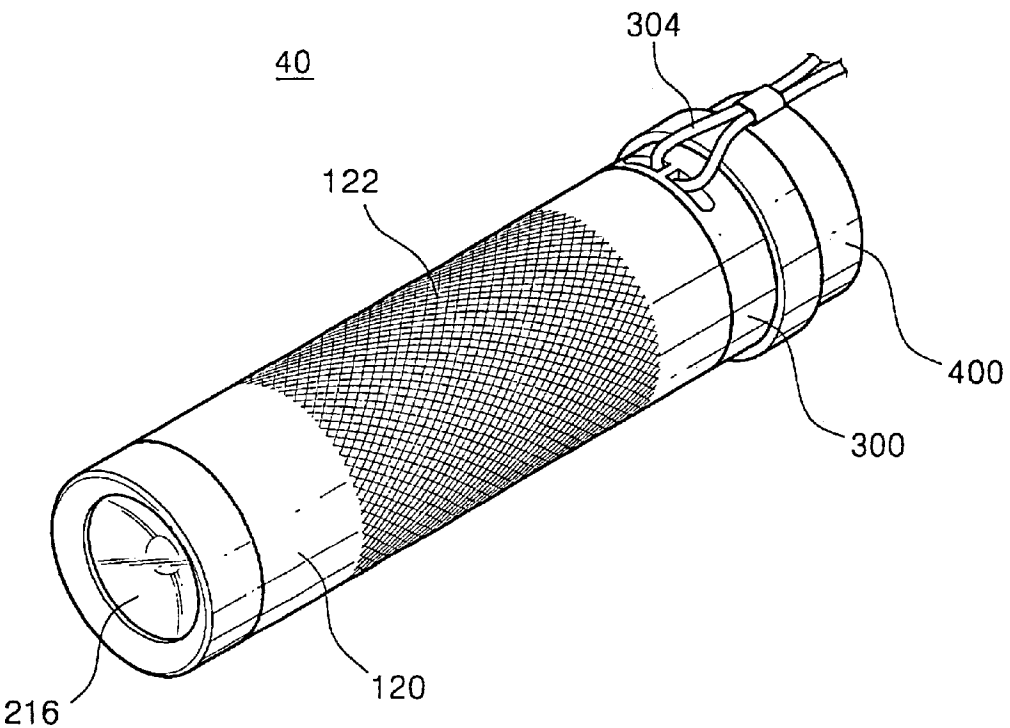
FIG. 7 is a perspective view of another LED flashlight modified from the LED flashlight according to one embodiment of the present invention.

FIG. 7 is a perspective view of an LED flashlight 40 according to still another embodiment of the present invention. According to the present embodiment, the LED flashlight 40 includes a conductive barrel 120 having an elastic skin 112 formed at an outer wall thereof with a knurling section for allowing a user to stably grip the conductive barrel 120.

Embodiment 2

Figure 8:
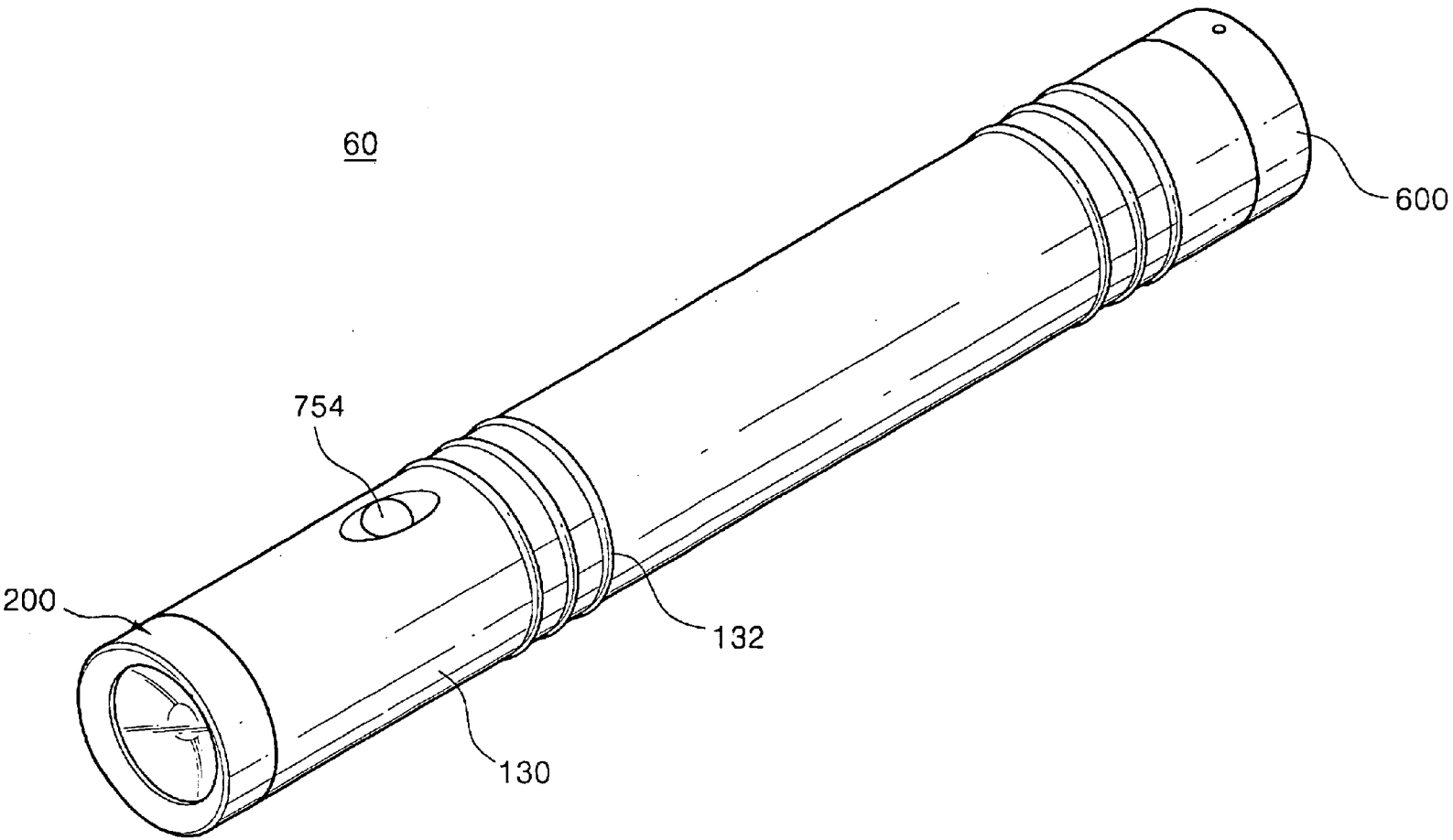
FIG. 8 is a perspective view of an LED flashlight according to another embodiment of the present invention.
Figure 9:
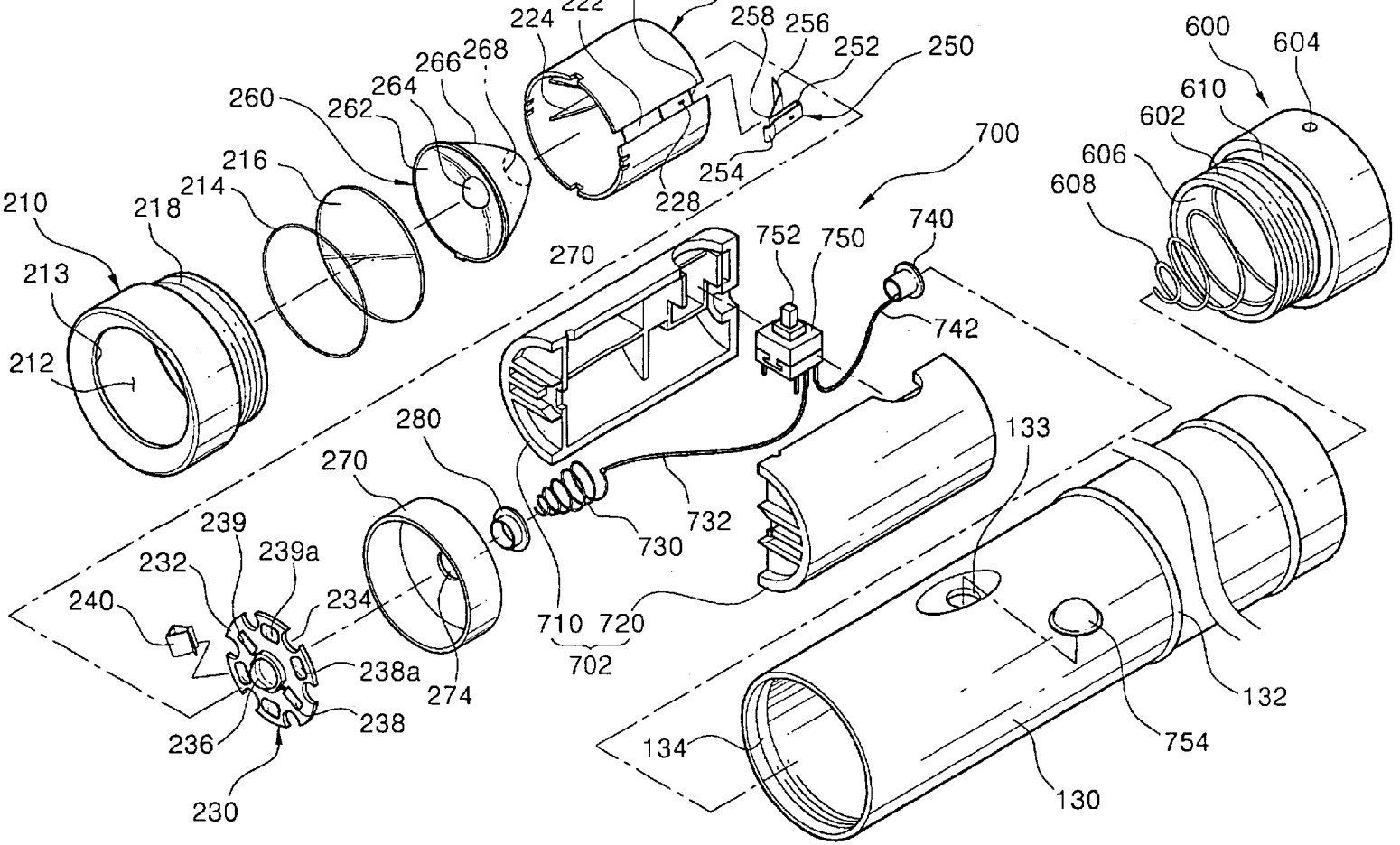
FIG. 9 is an exploded perspective view of the LED flashlight shown in FIG. 8.

FIG. 8 is a perspective view of an LED flashlight 60 according to a second embodiment of the present invention, and FIG. 9 is an exploded perspective view of the LED flashlight 60. The LED flashlight 60 of the present embodiment uses C-type battery and a push button switch is provided at a lateral portion thereof. A head section of the LED flashlight 60 is identical to the head section of the LED flashlight described in embodiment 1, so it will not be detailedly described below. The same reference numerals are used to refer the same parts.

The LED flashlight 60 includes a conductive barrel 130 having a length longer than a length of three C-type batteries aligned in series and an inner diameter larger than an outer diameter of the C-type battery. The conductive barrel 130 has a metallic cylindrical structure to provide a current path for electrically connecting a minus electrode of the battery to one terminal of a lamp.

Figure 10:
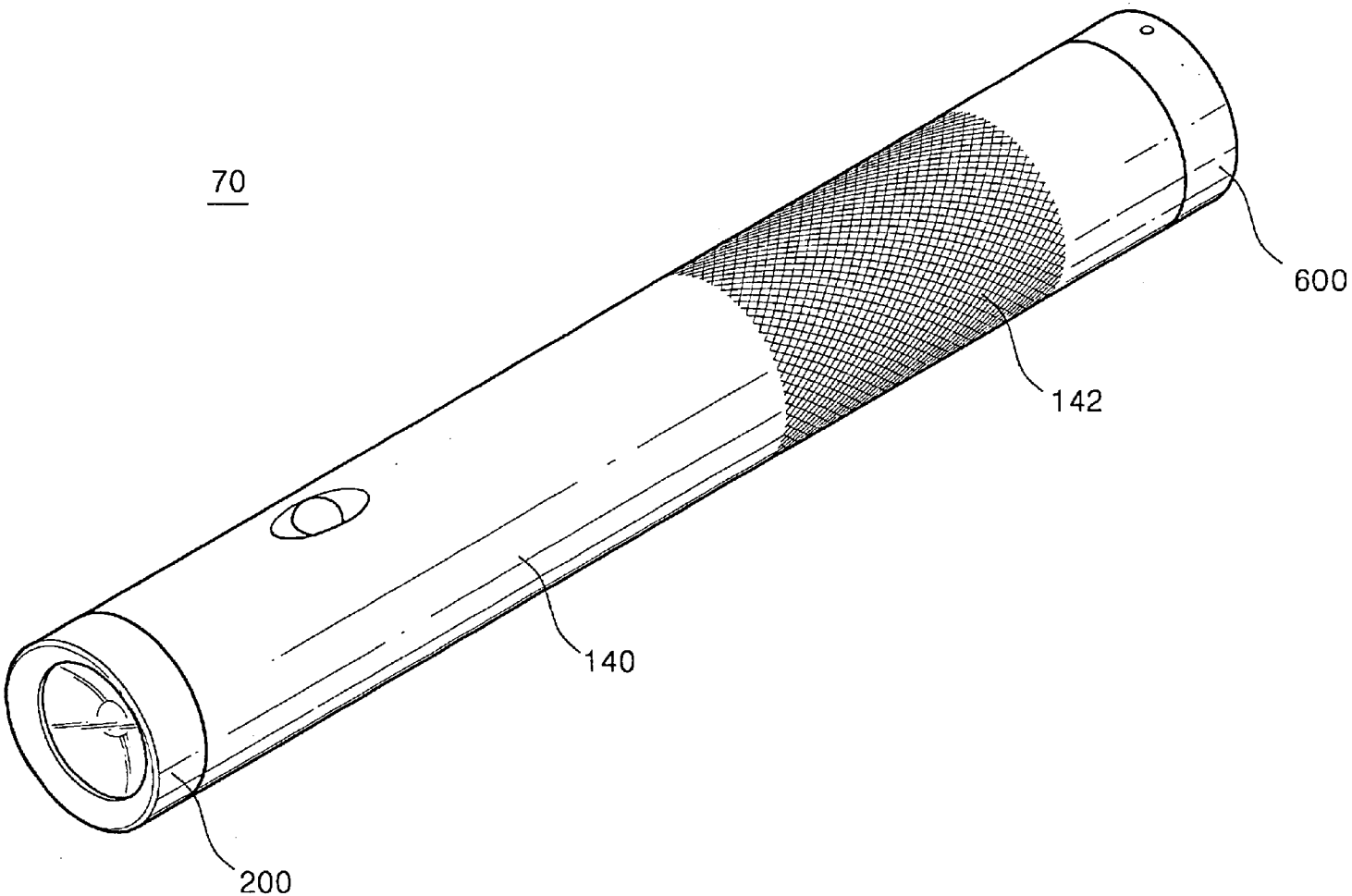
FIG. 10 is a perspective view of an LED flashlight modified from the LED flashlight according to another embodiment of the present invention.
Figure 11:
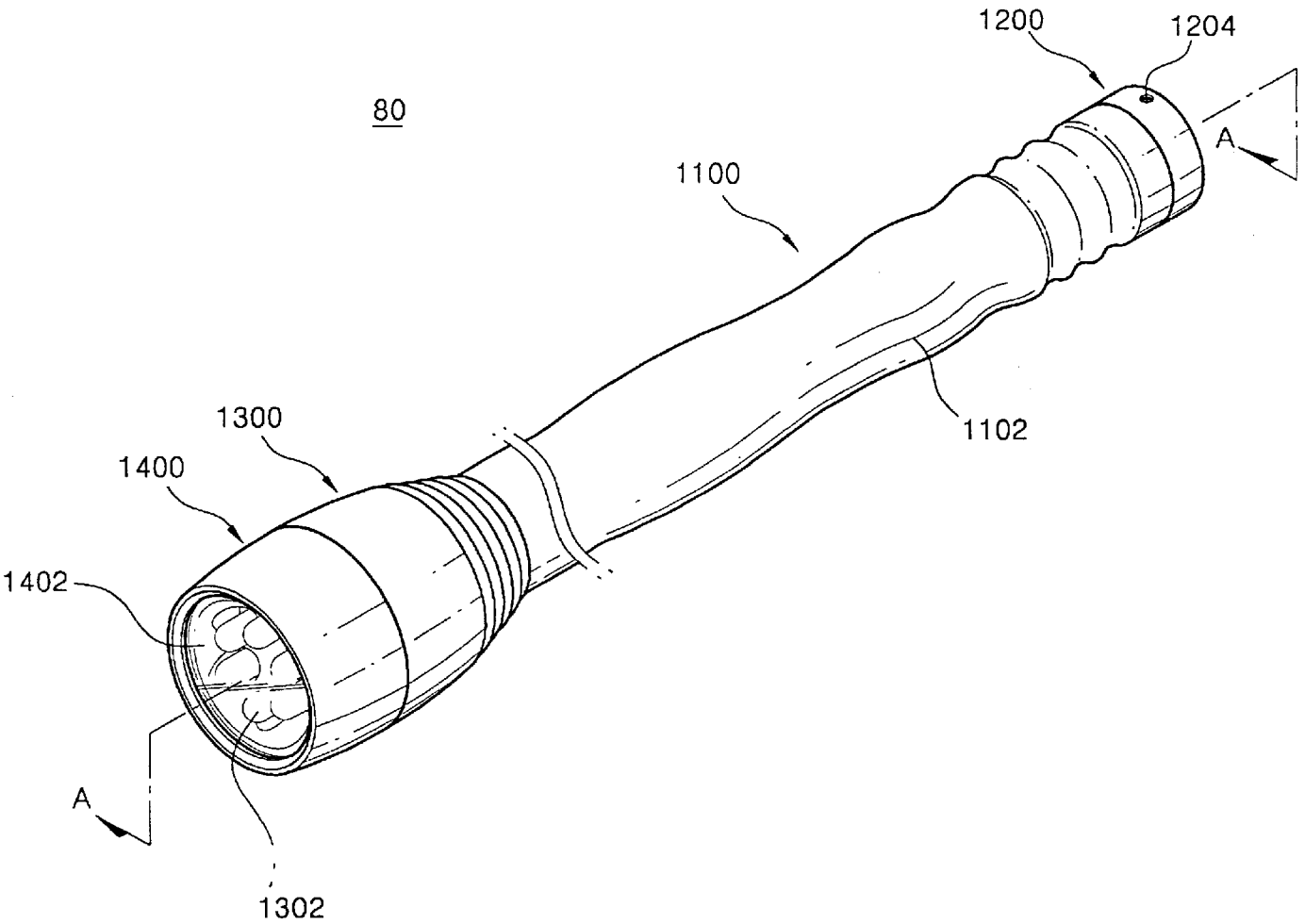
FIG. 11 is a perspective view of a multi-LED flashlight according to one embodiment of the present invention.
Figure 12:
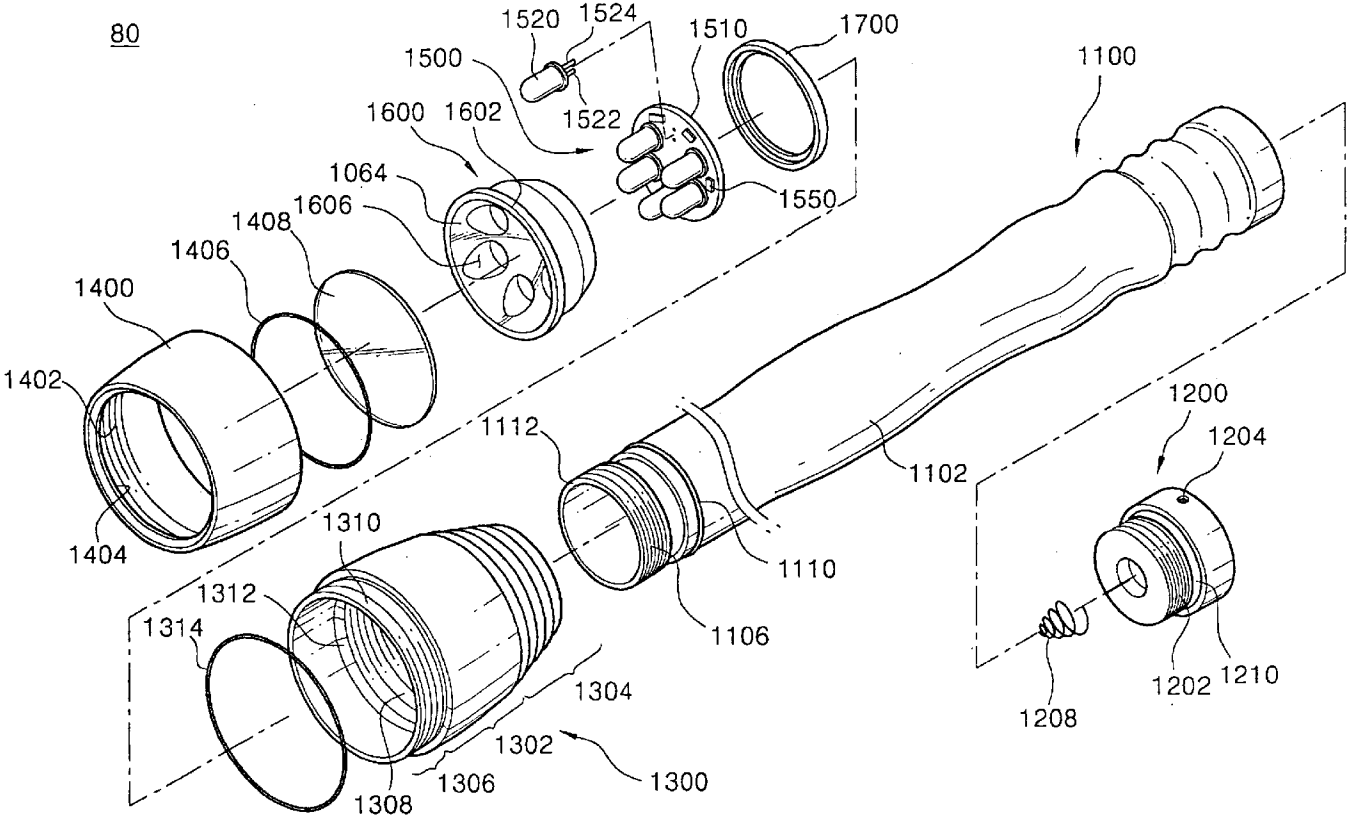
FIG. 12 is an exploded perspective view of the multi-LED flashlight shown in FIG. 11.
Figure 13:
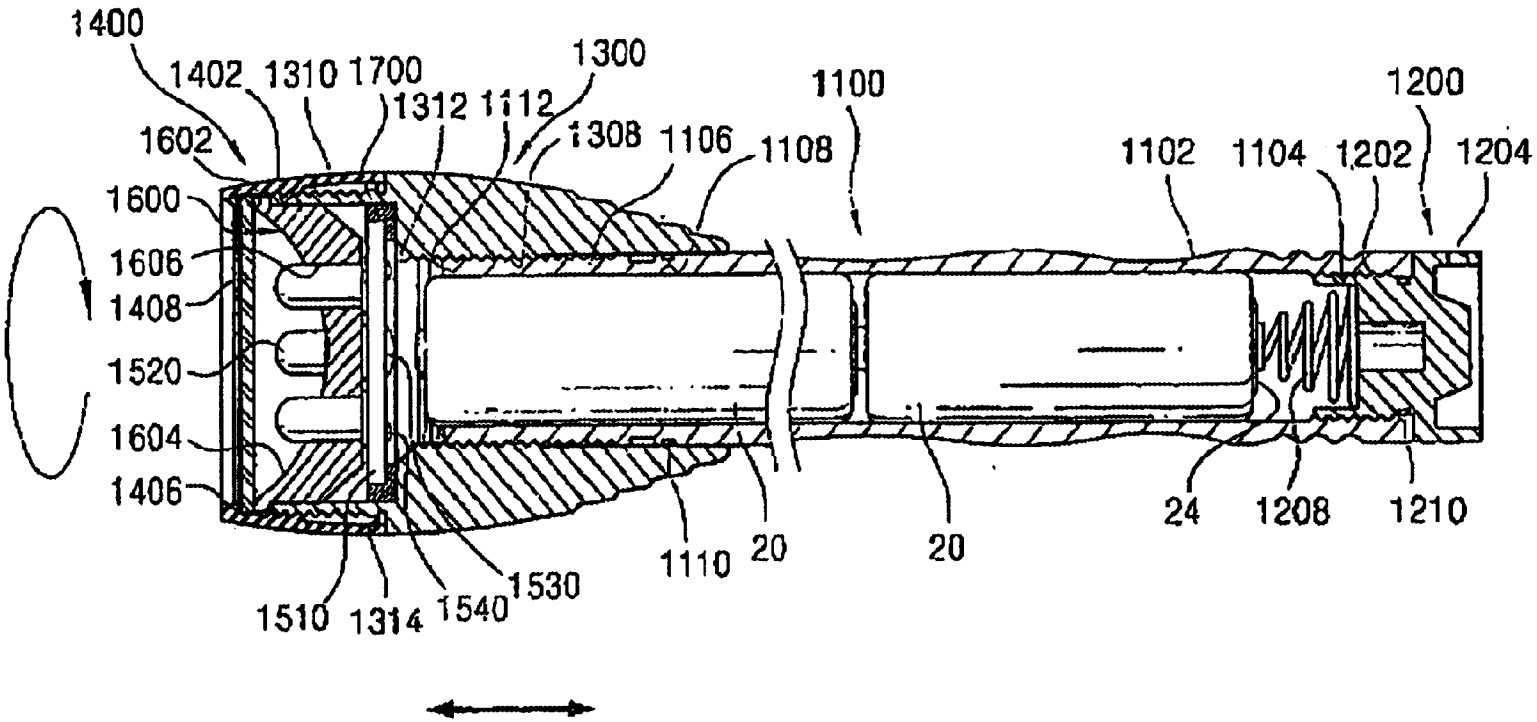
FIG. 13 is a sectional view taken along the line A—A of the multi-LED flashlight shown in FIG. 11 when power is off.
Figure 14:
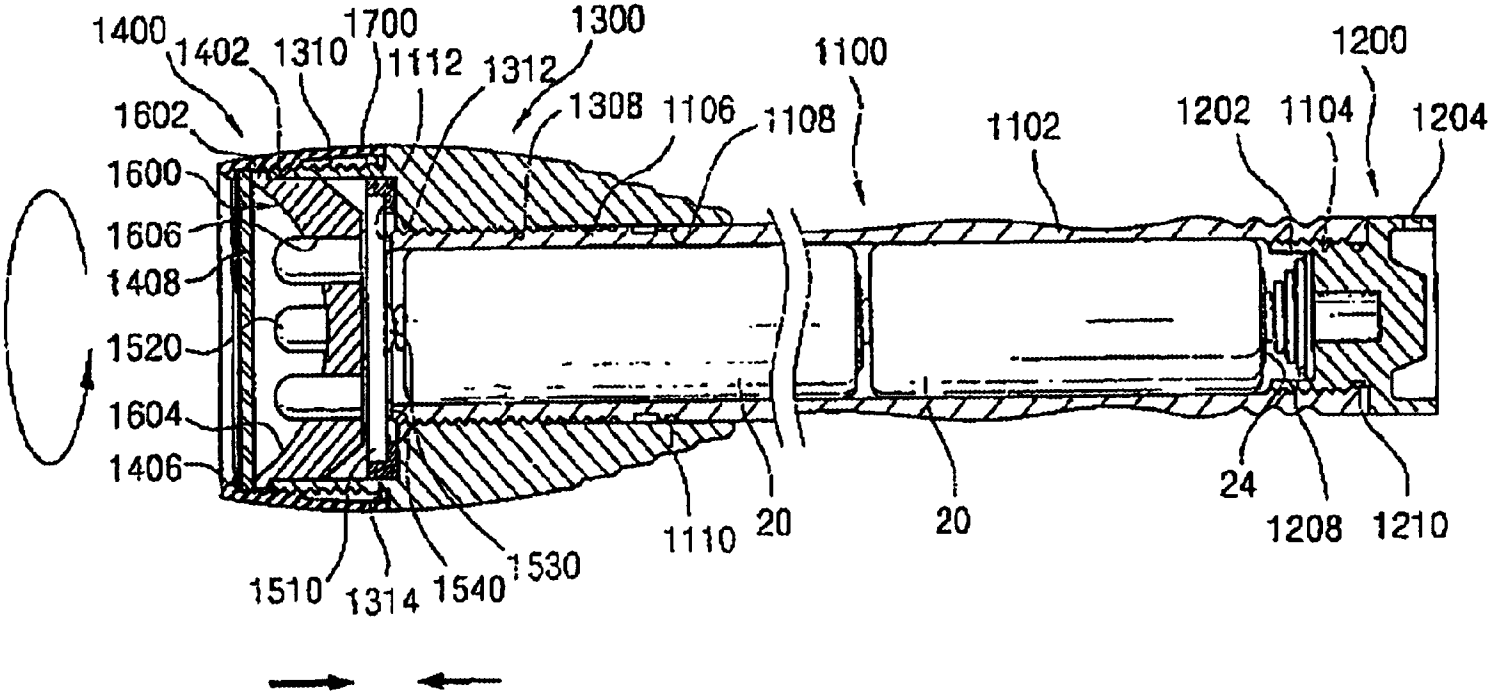

A plurality of rubber rings 132 are installed at an outer wall of the conductive barrel 130 so as to allow a user to stably grip the conductive barrel 130 while improving an external appearance of the conductive barrel 130. As shown in FIG. 10, instead of the rubber rings 132, a knurling section 142 can be formed at an outer wall of a conductive barrel 140 of an LED flashlight 70.

Referring to FIG. 9, a female-thread 134 is formed at an inner portion of a front end of the conductive barrel 130 and a male-thread (not shown) is formed at an inner portion of a rear end of the conductive barrel 130. The conductive barrel 130 is formed at a sidewall thereof with a perforation hole 133, through which a knob 752 of a switch 750 is protruded.

A tail cap 600 has a metallic cylindrical structure including a front end formed with a male-thread 602 and a rear end formed with a perforation hole 604. An outer diameter of the rear end is identical to an outer diameter of the conductive barrel 130. The front end is formed at a front center thereof with a recess 606, into which one end of a spring 608 is inserted. The other end of the spring 608 is forwardly protruded beyond a front surface of the tail cap 600.

One end of the spring 608 is electrically makes contact with an inner portion of the recess 606. The male-thread 602 formed in the front end of the tail cap 600 is screw-coupled into the male-thread formed in the inner portion of the rear end of the conductive barrel 130.

Thus, the tail cap 600 coupled to a rear portion of the conductive barrel 130 shields a rear part of the conductive barrel 130, through which the batteries are inserted.

An O-ring 610 is installed at a boundary section formed between the front end and the rear end of the tail cap 600 in order to seal an internal space of the conductive barrel 130 when the tail cap 600 is closed.

Pressure is applied to the minus electrode of the battery accommodated in the conductive barrel 130 through the spring 608 installed at the front surface of the tail cap 600. The spring 608 electrically connects the conductive barrel 130 to the minus electrode of the battery.

A push button switch assembly 700 includes a pair of semi-cylindrical members 710 and 720 forming an insulation case 702, a spring 730, a metal sleeve 740, and as switch 750. The spring 730 is installed at a front surface of the insulation case 702, and the metal sleeve 740 is installed at a rear surface of the insulation case 702. In addition, the knob 752 of the switch 750 is slightly protruded out of an outer wall of the insulation case 702. One terminal of the switch 750 is electrically connected to the spring 730 through a conductive wire 732 and the other terminal of the switch 750 is electrically connected to the metal sleeve 740 through a conductive wire 732.

The push button switch assembly 700 is transition-fitted into the conductive barrel 130 from a front portion of the conductive barrel 130. The knob 752 of the switch 750 is positioned in the perforation hole 133 and a rubber cover 754 is inserted into the perforation hole 133 in order to cover the knob 752.

Accordingly, the metal sleeve 740 of the push button switch assembly 700 is electrically connected to the plus electrode of the battery and a free end of the spring 750 installed at the front of the push button switch assembly 700 is connected to the metal layer 234 exposed to the perforation hole 274 of the metal cap 270. In order to prevent the spring 750 from electrically making contact with the metal cap 270 through the perforation hole 274, an insulating sleeve 280 is inserted into the perforation hole 274.

When the head section 210 is screw-coupled into the front portion of the conductive barrel 130, the metal cap 270 makes contact with the inner portion of the conductive barrel 130, so that heat generated from the lamp module 230 is discharged to an exterior through the conductive barrel 130.

An electric contact between the spring 730 and the metal sleeve 740 is turned on/off by pushing the knob 752 of the switch 750, thereby controlling the operation of the LED of the lamp module.

As described above, the LED flashlight uses a collimator lens so that light generated from a single LED is maximally focused and luminance of light is improved. In addition, the LED flashlight uses a metal cap in order to effectively prevent the temperature of a junction part from being increased when operating a high-luminance LED, through which current having intensity of a few milli-amperes (mA) passes, so the LED can be safely used with maintaining uniform luminance even if the LED is continuously used for a long time. In addition, since a plurality of protrusions are provided on the outer surface of the conductive barrel, the user feels a finger-massage effect when gripping the conductive barrel. The protrusions formed on the outer surface of the conductive barrel enlarges a surface area of the conductive barrel, so heat generated in the conductive barrel is effectively discharged out of the conductive barrel.

Embodiment 3

FIGS. 11 to 14 are views showing an LED flashlight 80 having a rotary type power on/off manner.

According to the present embodiment, the LED flashlight 80 includes a conductive barrel 1100, a tail cap 1200, a head case 1300, a head cap 1400, a lamp module 1500, a reflective mirror 1600, and a ring 1700 for discharging heat.

The conductive barrel 1100 has a length and a diameter adapted for sufficiently accommodating three AA-sized batteries 20 therein, in series. The conductive barrel 1100 has a metallic cylindrical structure providing a current path for electrically connecting a minus electrode 24 of the battery 20 to one terminal of the lamp module 1500.

The conductive barrel 1100 is formed at an outer surface thereof with a smooth curvature section 1102 having a sine-wave shape, in which a wavelength thereof becomes long from a rear end to a front end of the conductive barrel 1100. The curvature section 1102 is designed according to ergonomics, so that curvature section 1102 matches with the palm and fingers of the user when the user grips the flashlight. The curvature section 1102 prevents the conductive barrel 1100 from slipping out of a user's hand and improves an external appearance of the LED flashlight 80.

A female-thread 1104 is formed at a rear inner portion of the conductive barrel 1100 and a male-thread 1106 is formed at a front outer portion of the conductive barrel 1100. The male-thread 1106 formed at a front portion of the conductive barrel 1100 includes a three-thread screw. A slot 1108 is formed at a rear portion of the male-thread 1106 formed in the front end of the conductive barrel 1100. An O-ring 1110 is inserted into the slot 1108 for the purpose of sealing.

The tail cap 1200 has a metallic cylindrical structure including a front end formed with a male-thread 1202 and a rear end formed with a perforation hole 1204. An outer diameter of the rear end of the tail cap 1200 is identical to an outer diameter of the conductive barrel 1100. A recess 1206 is formed at a center portion of the front end of the tail cap 1200. One end of a spring 1208 is inserted into the recess 1206 and the other end of the spring is forwardly protruded beyond a front surface of the tail cap 1200.

One end of the spring 1208 is securely fixed in the recess 1206 so as to ensure an electric contact with respect to an inner portion of the recess 1206. The male-thread 1202 formed in the front end of the tail cap 1200 is screw-coupled into the male-thread 1104 formed in the inner portion of the rear end of the conductive barrel 1100.

Thus, the tail cap 1200 coupled to the rear portion of the conductive barrel 1100 shields a rear part of the conductive barrel 1100, through which the batteries 20 are inserted.

An O-ring 1210 is installed at a boundary section formed between the front end and the rear end of the tail cap 600 in order to seal an internal space of the conductive barrel 1100 when the tail cap 1200 is completely closed.

Pressure is applied to the minus electrode 24 of the battery 20 accommodated in the conductive barrel 1100 through the spring 1208 installed at the front surface of the tail cap 1200. The spring 1208 electrically connects the conductive barrel 1100 to the minus electrode 24 of the battery 20.

The head case 1300 has a metallic cylindrical structure including a middle part 1302, a rear end part 1304 and a front end part 1306. An inner diameter of the middle part 1302 is identical to an outer diameter of the conductive barrel 1100 and a female-thread 1308 is formed at an inner portion of the middle part 1302. The female-thread 1308 includes a three-thread screw. The rear end part 1304 has an inclined step structure. That is, an outer diameter of the rear end part 1304 gradually becomes smaller in a rear direction thereof in a range of an outer diameter of the middle part 1302 to the inner diameter of the middle 1302. The front end part 1306 has an outer diameter smaller than the outer diameter of the middle part 1302 and larger than the inner diameter of the middle part 1302. A female-thread 1310 is formed at an outer surface of the front end part 1306, and a stopping jaw 1312 is formed at a boundary section formed between an inner surface of the middle part 1302 and an inner surface of the front end part 1306. In addition, an O-ring 1314 is installed at a boundary section formed between an outer surface of the middle part 1302 and an outer surface of the front end part 1306.

The male-thread 1106 of the conductive barrel 1100 is screw-coupled into the female-thread 1308 of the head case 1300, so the head case 1300 moves forward or backward along an axial direction thereof when user rotates the head case 1300 in clockwise or counterclockwise direction. Since the female-thread 1308 and the male-thread 1106 are three-thread screws, the head case 1300 can move long-distance in the axial direction thereof when the user rotates the head case 1300. That is, the head case 130 moves by 3-pitches of the thread per one revolution thereof. Such head case structure allows the user to rapidly turn on/off the LED flashlight 80 because an axial moving distance of the head case 130 is long even if the user slightly rotates the head case 130.

The O-ring 1110 is positioned between the rear end part 1304 of the head case 1300 and the front end of the conductive barrel 1100 so as to seal therebetween.

The head cap 1400 has a metallic cylindrical structure, which is slightly tapered towards a front thereof. A female-screw 1402 is formed at an inner portion thereof, which is screw-coupled with the male-thread 1310 formed at the front end part 1306 of the head case 1300. An opening 1402 is formed at a front surface of the head cap 1400 and a locking protrusion 1404 is formed around the opening 1402. An O-ring 1406 and a transparent lens 1408 are sequentially installed from an inner portion of the locking protrusion 1404, thereby forming a transparent window through which light is radiated.

When performing an assembling work, the transparent lens 1408 is pressed between the locking protrusion 1404 and a front end of the head case 1300. Thus, the O-ring 1406 seals between the head cap 1400 and the transparent lens 1408.

The lamp module 1500 includes an insulating substrate 1510, a plurality of LEDs 1520, a center terminal 1530, a ring terminal 1540, and a resistance device 1550.

The insulating substrate 1510 includes a disc-shaped printed circuit board formed at upper and lower surfaces thereof with thin copper patterns. The insulating substrate 1510 has a diameter smaller than a diameter of the front end part of the head case 1300 and larger than a diameter of the rear end part of the head case 1300. The insulating substrate 1510 is rested on the stopping jaw 1312 of the head case 1300 with the ring 1700 surrounding an edge of the insulating substrate 1510.

Six LEDs 1520 are provided on the front surface of the insulating substrate 1510 in such a manner that each of six LEDs 1520 is positioned on each vertex of angle of a hexagon. The LED 1520 is a white LED having high-luminance of 800 to 3,000 mcd, for example, model name NSPW500BS available from Nichia company, Japan. A yellow-based fluorescent layer is coated on a light emitting surface of a blue LED so as to generate white light.

The ring 1700 is made of metal having superior thermal conductivity and has an inner diameter larger than an outer diameter of a ring terminal 1540. An outer diameter of the ring 1700 is slightly smaller than the inner diameter of the front end part of the head case 1300, so the ring 1700 is press-fitted into the front end part of the head case 1300. The ring 1700 has an L-shaped section area adapted for surrounding lateral and rear edge parts of the insulating substrate 1510, so a contact area is increased, thereby improving thermal conductivity. Accordingly, heat generated from the thin copper pattern formed at the lower surface of the insulating substrate 1510 is transferred to head case 1300 through the ring 1700, thereby preventing the ambient temperature of the LED 1520 from being unnecessarily increased.

The reflective mirror 1600 has a cup-shape, which is tapered towards a rear portion thereof. A rim 1602 is formed at a front end of an inlet of the reflective mirror 1600. The rim 1602 is coupled to the front edge of the head case 1300. An inner portion 1064 of the reflective mirror 1600 has a parabolic shape formed with six perforation holes 1606 corresponding to the six LEDs 1520. The LEDs 1520 are inserted into the six perforation holes 1606 and protruded beyond the inner portion 1064 of the reflective mirror 1600.

Figure 15A:
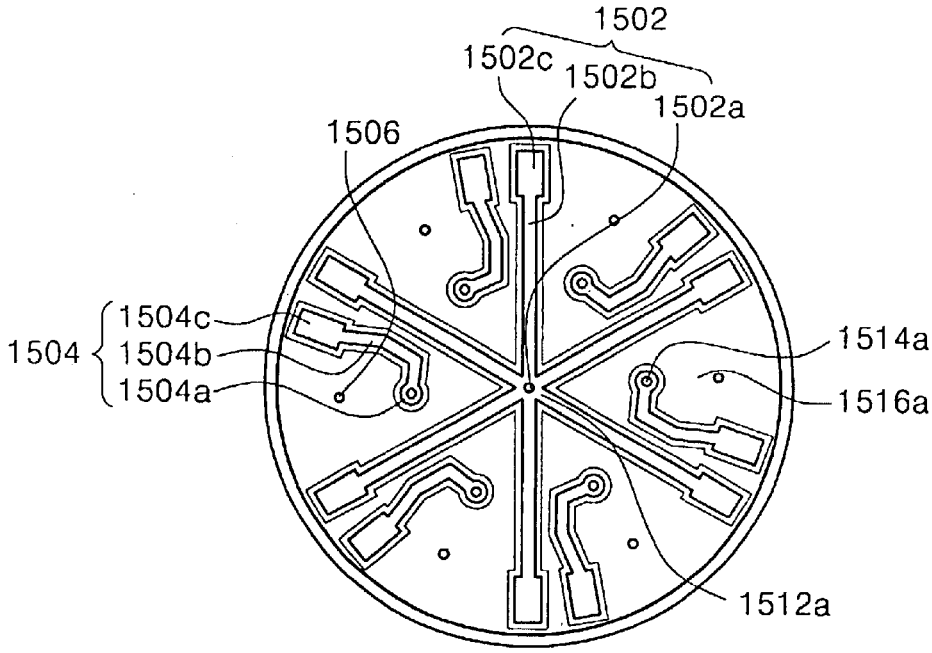
FIG. 15A is a view showing a 6-LED type printed circuit pattern formed on an upper surface of an insulating substrate according to one embodiment of the present invention.

Referring to FIG. 15A, a printed circuit pattern formed on the upper surface of the insulating substrate 1510 includes a radial line pattern 1502, an anode line pattern 1504, and a cathode pattern 1506.

The radial line pattern 1502 includes lines 1502*b* extending in six, directions from a center 1502*a* thereof and line pads 1502*c* formed at each terminal of lines 1502*b*. The lines 1502*b* extend radially outward from the center 1502*a* along boundary lines uniformly dividing the insulating substrate 1510 into six areas corresponding to the number of LEDs 1520.

The anode line pattern 1504 includes circular-shaped pads 1504*a* formed at an each center of six areas divided by the radial line pattern 1502, anode lines 1504*b* extending from the circular-shaped pads 1504 towards an adjacent line 1502*b* by a predetermined distance, and then, bending in parallel to the adjacent line 1502 towards a circumferential portion of the insulating substrate 1510, and line pads 1504*c* formed at each terminal of anode lines 1504*b*.

The cathode pattern 1506 is spaced from the radial line pattern 1502 and the anode line pattern 1504 by a predetermined distance and covers six areas divided by the radial line pattern 1502 except for the anode line pattern 1504. That is, a plurality of cathode patterns 1506 are arranged to form a maximum area within a given space, thereby facilitating heat-discharge of the LEDs.

The resistance device 1550 is attached between the line pad 1502*c* of the radial line pattern 1502 and the line pad 1504*c* of the anode pattern 1504 by a soldering work. The resistance device 1550 limits current supplied to the LED to have intensity of tens of milli-amperes (mA), for example, 50 to 60 mA under forward driving voltage of 4.5V.

When model name NSPW500BS available from Nichia Company is used as the LED, maximum forward current is 30 mA. Therefore, if resistance is not used, great amount of forward current is applied to the LED in an initial stage, so luminance of the LED is improved. However, as the LED has been used for a long time, the temperature of the junction part of the LED is increased so that intensity of forward current is gradually dropped due to thermal resistance. Thus, luminance of the LED is lowered as compared with luminance of the LED in the initial stage.

However, according to the present invention, forward current is limited to 50 to 60 mA by using the resistance device 1550. Even if forward current exceeding a maximum rated value is applied to the LED for maximizing luminance of the LED, a heat sink structure of the present invention can prevent the ambient temperature of the LED from being increased, so the LED maintains uniform luminance even if the LED has been used for a long time.

Figure 15B:
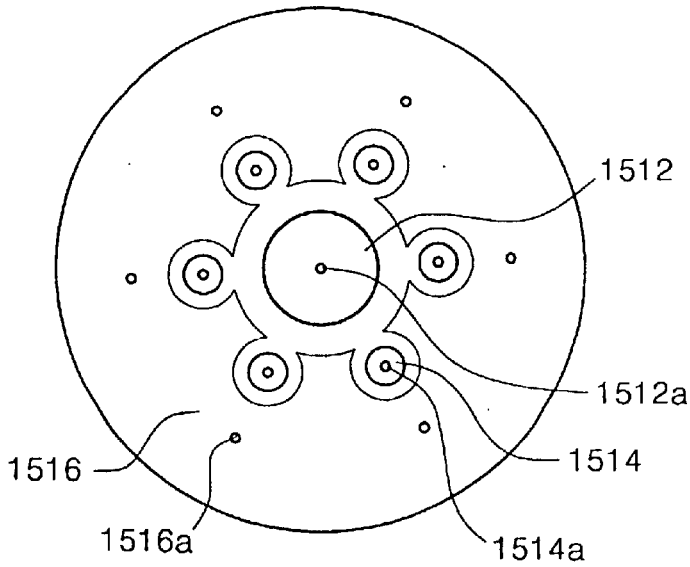
FIG. 15B is a view showing a 6-LED type printed circuit pattern formed on a lower surface of an insulating substrate according to one embodiment of the present invention.

Referring to FIG. 15B, a printed circuit pattern formed on the lower surface of the insulating substrate 1510 includes a plus pad 1512, six anode pads 1514, and a minus pad 1516.

The plus pad 1512 is formed at a center of the lower surface of the insulating substrate 1510 and has a circular shape formed at a center thereof with a perforation hole 1512*a*. The center terminal 1530 is formed by a soldering work in such a manner that the center terminal is slightly protruded from the plus pad 1512. A part of solder flows into the upper surface of the insulating substrate 1510 through the perforation hole 1512*a* and is solidified on the upper surface of the insulating substrate 1510 so that the center terminal 1530 is electrically connected to the center 1502*a* of the radial line pattern 1502 formed at the upper surface of the insulating substrate 1510.

Six anode pads 1514 are circularly aligned around the plus pad 1512 corresponding to circular-shaped pads 1504*a* of the anode line pattern 1504, while being spaced from each other in an equi-distance. A perforation hole 1514*a* is formed at each center of six anode pads 1514.

The ring-shaped minus pad 1516 surrounds six anode pads 1514 from an outer peripheral portion of the six anode pads 1514. In addition, six perforation holes 1516*a* are formed remote from the six perforation holes 1514*a* by a distance corresponding to an interval between an anode lead wire 1522 and a cathode lead wire 1524 of the LED 1520. The ring-shaped minus pad 1516 preferably has a large surface area so as to discharge heat generated from the LED 1520 to the exterior.

The anode lead wire 1522 and the cathode lead wire 1524 of the LED 1520, which are corresponding to perforation holes 1516*a* of the ring-shaped minus pad 1516, which are corresponding to the perforation holes 1514 formed in the anode pad 1514, are inserted into the upper surface of the insulating substrate 1510 and withdrawn through the lower surface of the insulating substrate 1510. The lead wires withdrawn through the lower surface of the insulating layer 1510 are cut away while remaining a predetermined length about 1–2 mm. Accordingly, a plurality of white LEDs are aligned on the upper surface of the insulating substrate 1510 such that light is forwardly radiated.

Figure 15C:
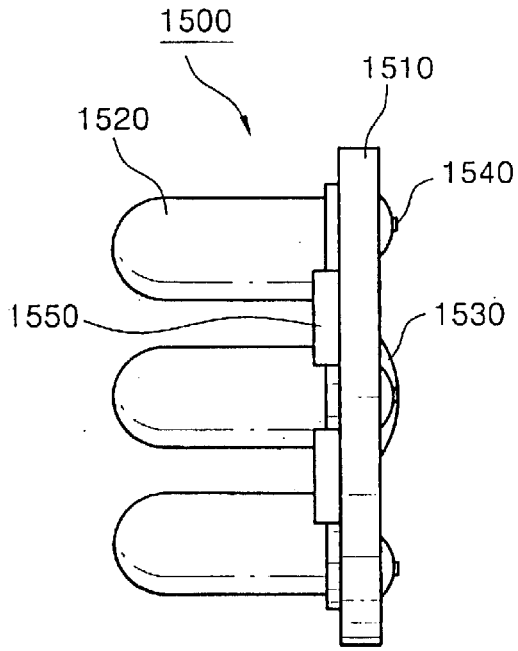
FIG. 15C is a view showing a lateral structure of a 6-LED type lamp module formed in an insulating substrate according to one embodiment of the present invention.
Figure 15D:
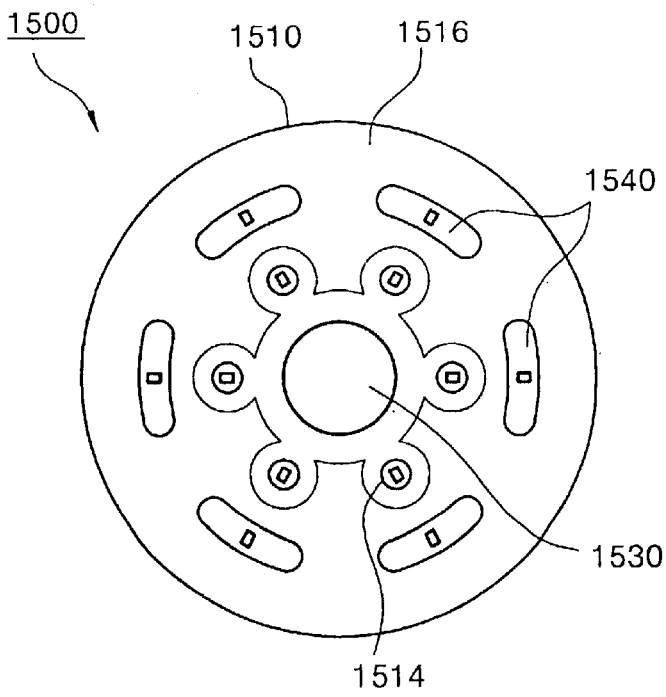
FIG. 15D is a view showing a bottom structure of a 6-LED type lamp module formed in an insulating substrate according to one embodiment of the present invention, after a soldering work has been finished.

The ring terminal 1540 extends in a circumferential direction of the insulating substrate 1510 by soldering a plurality of cathode lead wires 1524 protruded through the perforation holes 1516*a* of the minus pad 1516 formed at the lower surface of the insulating substrate 1510. The ring terminal is slightly protruded from the lower surface of the insulating substrate 1510. The ring terminal 1540 can be formed in a perfect circular shape by integrally connecting soldering parts with each other or can be formed in a disconnected circular pattern as shown in FIGS. 15C and 15D. At this time, the minus pad 1516 is electrically connected to the cathode pattern 1506 due to solder flowing into the upper surface of the insulating substrate 1510 through the perforation holes 1516*a*.

When soldering the anode lead wires 1522 of the LED 1520 protruded through the perforation holes 1514*a* of the anode pad 1514, a part of solder flows into the upper surface of the insulating substrate 1510 through the perforation holes 1514*a* and is solidified on the upper surface of the insulating substrate 1510, thereby forming an electric connection with respect to the circular-shaped pads 1504*a* of the anode line pattern 1504.

Accordingly, referring to FIG. 4, an electric connection under the power-on state of the present invention can be achieved in the order of battery plus electrode-center electrode 1530-radial line pattern 1502-resistance device 1550-anode line pattern 1504-anode lead wire 1522-LED 1520-cathode lead wire 1524-ring terminal 1540-conductive barrel 1100-tail cap 1600-spring 1602-battery minus electrode.

Referring to FIGS. 3 and 4, a power on/off switching is carried out by turning on/off a contact between the ring terminal 1540 and the front end 1112 of the conductive barrel 1100. That is, the ring terminal 1540 intermittently makes contact with the front end 1112 of the conductive barrel 1100 due to a relative reciprocating movement of the conductive barrel 1100 caused by the rotation of the head case 1300 or the conductive barrel 1100.

Figure 16A:
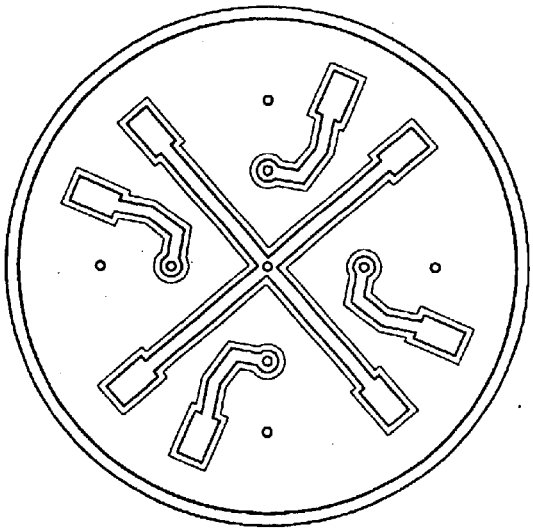
FIG. 16A is a view showing a 4-LED type printed circuit pattern formed on an upper surface of an insulating substrate according to one embodiment of the present invention.
Figure 16B:
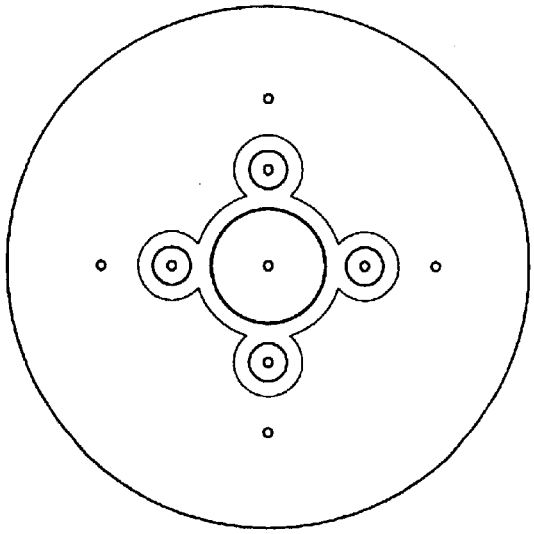
FIG. 16B is a view showing a 4-LED type printed circuit pattern formed on a lower surface of an insulating substrate according to one embodiment of the present invention.
Figure 17A:
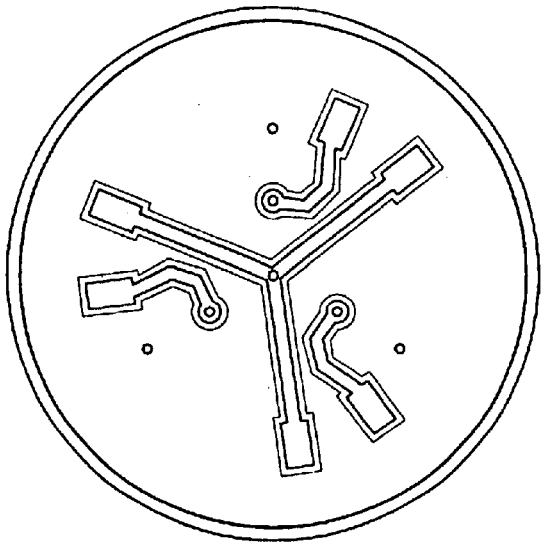
FIG. 17A is a view showing a 3-LED type printed circuit pattern formed on an upper surface of an insulating substrate according to one embodiment of the present invention.
Figure 17B:
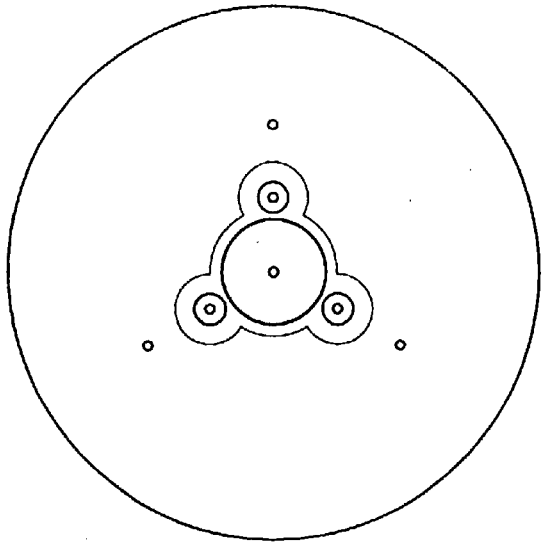
FIG. 17B is a view showing a 3-LED type printed circuit pattern formed on a lower surface of an insulating substrate according to one embodiment of the present invention.

FIGS. 16A and 16B are views showing a printed circuit pattern formed on the insulating substrate when four LEDs are formed in the lamp module, and FIGS. 17A and 17B are views showing a printed circuit pattern formed on the insulating substrate when three LEDs are formed in the lamp module.

As the number of LEDs is reduced, an interval between the LEDs is enlarged so a diameter of a concentric circle for aligning the LEDs is gradually narrowed. In addition, a position of the resistance device positioned between the LEDs is shifted from an edge towards a center so that the resistance device is aligned at a middle part. Accordingly, it is preferred that the cathode pattern provided on the upper surface of the insulating substrate is integrally formed at the edge of the insulating substrate without being separately provided into divided areas, thereby maximizing the surface area of the pattern to easily discharge heat.

Embodiment 4

Figure 18:
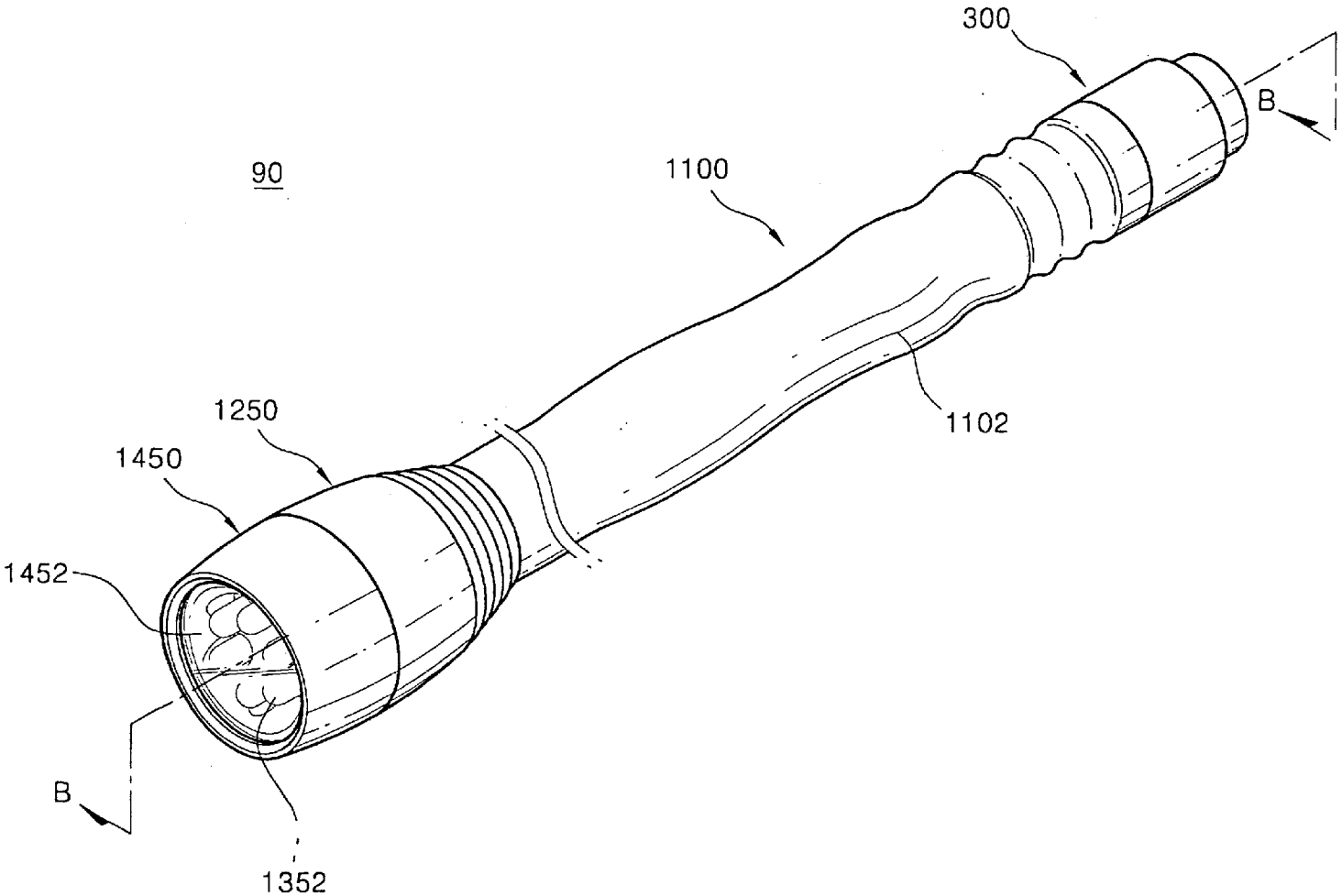
FIG. 18 is a perspective view of a rear push button type LED flashlight modified from the multi-LED flashlight according to the present invention.
Figure 19:
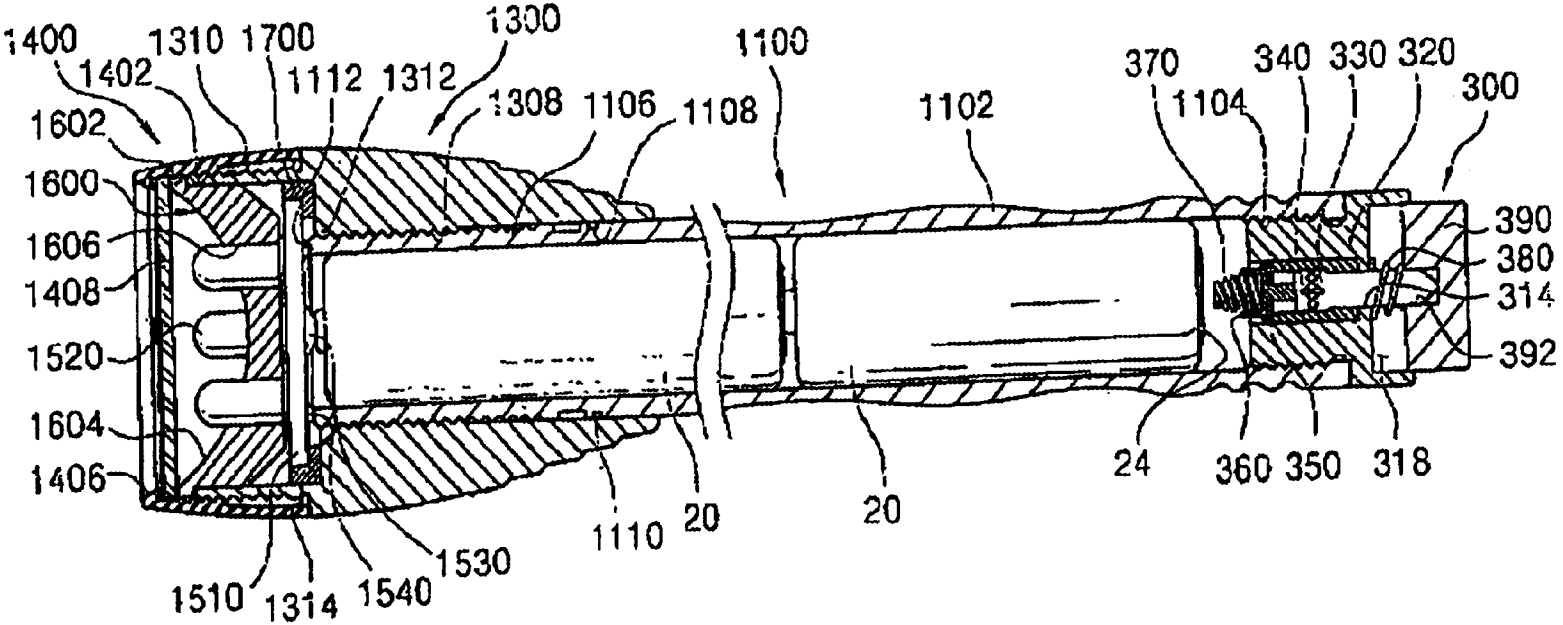
FIG. 19 is a sectional view taken along the line B—B of the rear push button type LED flashlight shown in FIG. 18.

FIGS. 18 and 19 are views showing a rear push button type LED flashlight according to another embodiment of the present invention. Embodiment 4 is similar to above-described embodiment 3, except for a push button switch installed at a tail cap. The structure of the tail cap including the rear push button switch is identical to the structure of the tail cap described in embodiment 1.

A rear push button type LED flashlight 90 includes a tail cap 300 formed with a male-thread 316 and a conductive barrel 1100 formed with a female-thread 105 screw-coupled with the male-thread 316.

Thus, the LED flashlight 80 of embodiment 3 requires both hands of the user for rotating the head case or the conductive barrel to turn on/off power, but the LED flashlight 90 of the present embodiment only requires one hand of the user to turn of/off power because the user can turn on/off power by just pushing the push button.

As shown in FIG. 19, a head case 300 of the LED flashlight 90 is fixedly coupled to the conductive barrel 1100, so the ring terminal 1540 always makes contact with the front end 1112 of the conductive barrel 1100.

Figure 20:
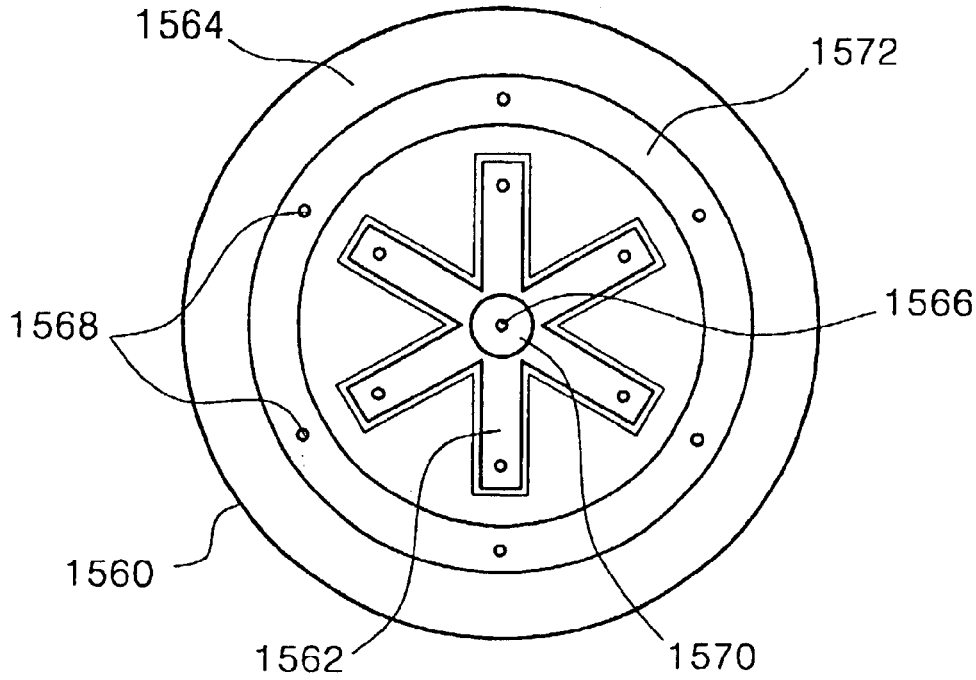
FIG. 20 is a view showing a lamp module according to another embodiment of the present invention.

FIG. 20 is a view showing a lamp module according to another embodiment of the present invention. The lamp module has no resistance devices and a plurality of LEDs are provided on an upper surface (front surface) of an insulating substrate 1560 without a printed circuit pattern. A star-like plus pad 1562 and a ring-shaped minus pad 1564 are formed at a lower surface (rear surface) of the insulating substrate 1560. A perforation hole 1566 is formed at each terminal of radial branches of the star-like plus pad 1562. In addition, a plurality of perforation holes 1568 are formed in the minus pad 1564 corresponding to the perforation holes 1566. Anode lead wires of the LED are withdrawn from the upper surface to the lower surface of the insulating substrate through the perforation holes 1566 and the cathode lead wires are withdrawn from the upper surface to the lower surface of the insulating substrate through the perforation holes 1568.

The anode lead wires and the cathode lead wires withdrawn through the lower surface of the insulating substrate are cut away such that predetermined portions (about 1–2 mm) of the anode lead wires and the cathode lead wires remain, protruding from the lower surface of the insulating substrate. The protruded lead wires are soldered in such a manner that the anode lead wires are commonly connected to the plus pad 1562 and the cathode lead wires are commonly connected to the minus pad 1564.

A separate soldering protrusion is formed at a center of the plus pad 1562 so as to form a center terminal and a ring terminal 1572 is formed by performing a soldering work along a concentric circle connecting the cathode lead wires.

Figure 21A:
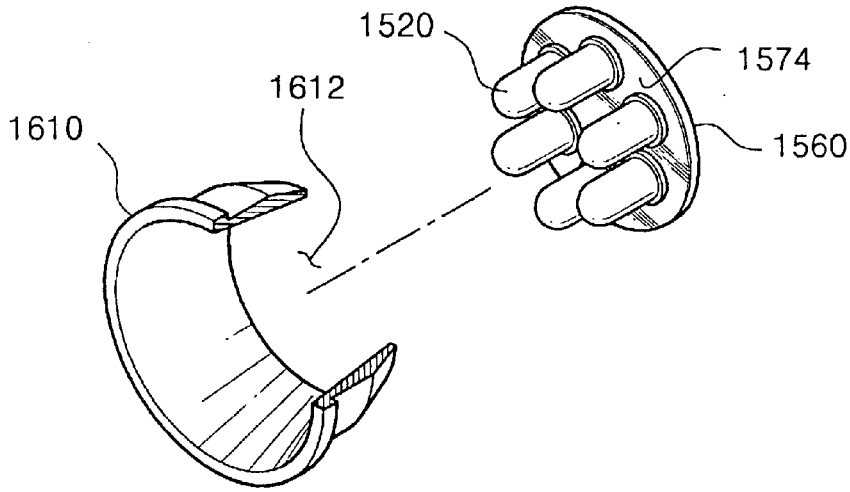
FIG. 21A is a view showing a reflective mirror according to another embodiment of the present invention.
Figure 21B:
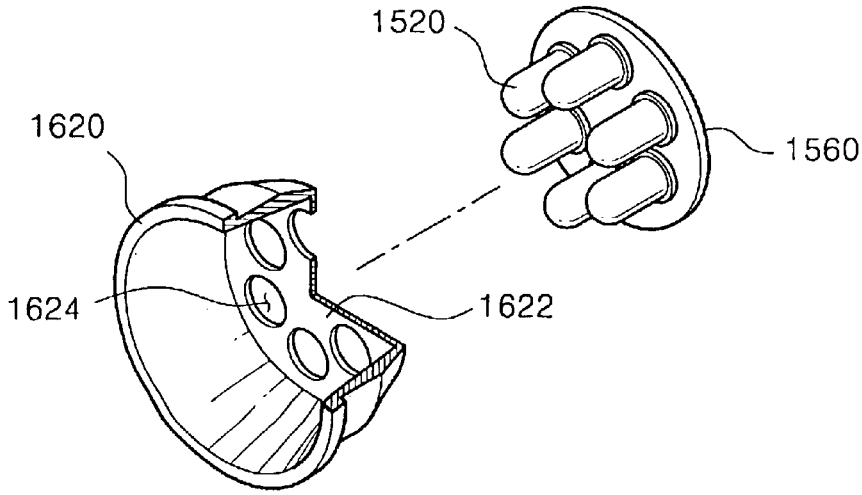
FIG. 21B is a view showing a reflective mirror according to still another embodiment of the present invention.

FIGS. 21A and 21B are views showing a modified reflective mirror structure.

A reflective mirror 1610 shown in FIG. 21A has a bottomless cylindrical structure. A reflective layer 1574 is formed at the upper surface of the insulating substrate 1560. The reflective layer 1574 acts as a bottom of the reflective mirror 1610. A rear end portion of the reflective mirror 1610 is tapered towards a rear portion thereof. A rear end 1612 of the reflective mirror 1610 has a diameter sufficient for accommodating six LEDs 1520 therein.

A reflective mirror 1620 shown in FIG. 21B has a cylindrical structure having a bottom 1622. Six perforation holes 1624 corresponding to six LEDs 1520 are formed in the bottom 1622 so as to receive the LEDs 1520. Different from the reflective mirror 1600, the reflective mirror 1620 has no parabolic section in the inner surface thereof.

Embodiment 5

Figure 22:
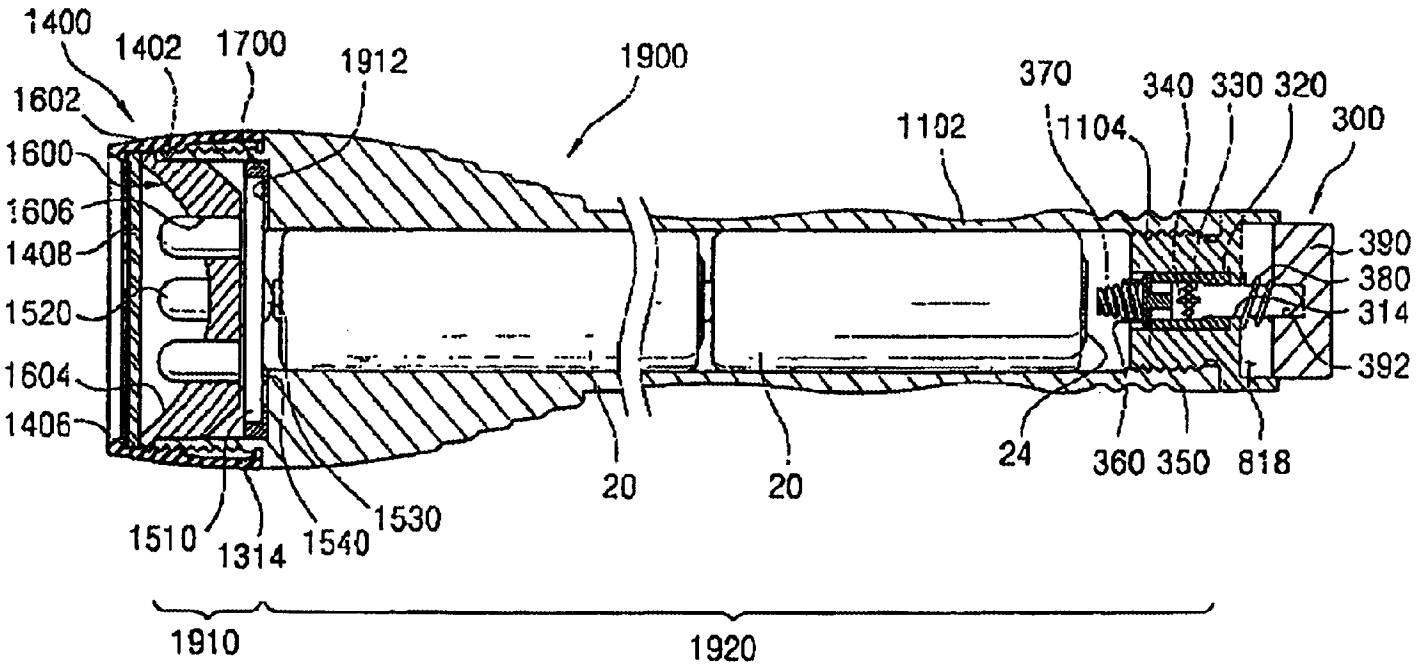
FIG. 22 is a sectional view showing a multi-LED flashlight according to another embodiment of the present invention.

FIG. 22 is a sectional view showing an LED flashlight 95 according to another embodiment of the present invention. The LED flashlight 95 shown in FIG. 22 is similar to LED flashlights 80 and 90, except for the structure of a conductive barrel 1900, which is integrally formed with a head case and a rear push button type tail cap is assembled thereto. The same numerals are used to refer the same parts and the same parts will not be detailedly described below.

The conductive barrel 1900 includes a head section 1910 and a housing section 1920. A locking jaw 1912 is formed at a boundary between the head section 1910 and the housing section 1920. A ring terminal 1540 of a lamp module 1500 directly makes contact with the locking jaw. Power is turned on/off by means of a rear push button switch.

As described above, the present invention provides a plurality of LEDs as a lamp module, so a connection structure between a battery and a lamp is remarkably simplified. Accordingly, the number of parts as used can be reduced, and workability and productivity can be improved, while reducing fault and error of the LEDs.

In addition, heat generated from high-luminance LEDs can be effectively discharged out of a conductive barrel through a metal cap or a metal ring, so current exceeding rated current can be applied to the high-luminance LEDs, thereby improving luminance of the LEDs. Furthermore, the LEDs of the present invention uniformly maintain luminance thereof for a long time, so reliability of the LEDs can be improved.

While the present invention has been described in detail with reference to the preferred embodiments thereof, it should be understood to those skilled in the art that various changes, substitutions and alterations can be made hereto without departing from the scope of the invention as defined by the appended claims.

What is claimed is:

1. A flashlight comprising:

a conductive barrel for receiving at least one battery therein;

a conductive tail cap detachably coupled to a rear end of the conductive barrel and electrically connecting a minus electrode of the battery accommodated in the conductive barrel to the conductive barrel through a spring; and a head section detachably coupled to a front end of the conductive barrel, wherein the head section includes a conductive head cap detachably coupled to the front end of the conductive barrel and having a transparent window for radiating a light on a front surface thereof;

an insulation case having a front end and a slot, the front end being inserted into the conductive head cap from a rear end of the conductive head cap towards the transparent window, and the slot being formed at an outer wall thereof and extending lengthwise the insulation case;

a lamp module assembled into an inner rear end of the insulation case and having an insulating substrate, the insulating substrate including an LED at a front center portion thereof, an anode electrode terminal and a cathode electrode terminal of the LED being arranged around the LED, and a metal layer being connected to a positive electrode of the battery and being coated one rear surface thereof for discharging heat;

a U-shaped first connecting conductor inserted to a peripheral portion of the insulating substrate in order to electrically connect the anode electrode to the metal layer;

a second connecting conductor having a first end and a second end opposite to the first end, the first end being installed in the slot of the insulation case so as to electrically come into contact with an inner portion of the conductive head cap, and the second end extending into the insulation case to be connected with the cathode electrode terminal of the lamp module; and a collimator lens assembled into an inner portion of the insulation case between the transparent window and the insulating substrate in order to forwardly refract light radiated from the LED.

2. The flashlight as claimed in claim 1, wherein the head section further includes a metal cap attached to the metal layer by interposing insulation adhesive having high thermal conductivity and electric insulation characteristic, the metal cap coming into contact with the inner portion of the conductive barrel, to thereby discharge heat to an exterior by transferring heat from the metal layer to the conductive barrel.

3. The flashlight as claimed in claim 2, wherein the metal cap has a perforation hole formed at a center thereof for bringing the plus electrode of the battery into contact with the metal layer.

4. The flashlight as claimed in claim 3, wherein the metal cap further includes an insulation ring inserted into the perforation hole so as to prevent the positive electrode of the battery from making contact with the metal cap through the perforation hole.

5. The flashlight as claimed in claim 2, wherein the metal cap surrounds a rear end of the insulation case, and a front end of the metal cap makes contact with the rear end of the conductive head cap.

6. The flashlight as claimed in claim 2, wherein the flashlight includes a battery holder accommodated in the conductive barrel.

7. The flashlight as claimed in claim 6, wherein the battery holder receives three AAA-type batteries in a row, the three AAA-type batteries being electrically connected to each other in series.

8. The flashlight as claimed in claim 7, wherein the battery holder includes:

a body for detachably holding a plurality of batteries in a row and for electrically connecting the batteries in series;

a plus conductor formed at a front surface of the body and electrically making contact with the metal layer; and a minus conductor formed at a rear surface of the body and electrically making contact with the spring of the conductive tail cap.

9. The flashlight as claimed in claim 1, wherein a length of the conductive barrel is identical to or longer than a width of an adult's palm.

10. The flashlight as claimed in claim 9, wherein the conductive barrel has a plurality of protrusions formed on an outer surface thereof, to thereby provide a finger-massage effect to a user.

11. The flashlight as claimed in claim 9, wherein the conductive barrel is surrounded by an elastic skin on which a plurality of protrusions are formed, to thereby provide a finger-massage effect to a user.

12. The flashlight as claimed in claim 9, wherein an outer surface of the conductive barrel has a knurling section.

13. The flashlight as claimed in claim 1, wherein the insulation case has a plurality of supporting pieces for supporting the collimator lens, each of the supporting pieces being protruded from the inner portion of the insulation case towards a center of the insulation case.

14. The flashlight as claimed in claim 1, wherein the first end of the second connecting conductor has an elastic structure so as to surely make contact with the inner portion of the conductive head cap.

15. The flashlight as claimed in claim 1, wherein the conductive tail cap includes a push button switch.

16. The flashlight as claimed in claim 1, wherein the push button switch includes:

a push button inserted into a hole formed at a rear surface of a tail cap body in such a manner that the push button moves forwards when pressure is applied and returns to an initial position by elastic force of a spring when pressure is released;

a moving member inserted into the hole of the tail cap body in such a manner that the moving member is selectively toggled in an advanced state or in a moving-back state according as the moving member is pushed corresponding to a pushing operation of the push button;

a conductive member having a perforation hole at a center thereof and electrically making contact with the tail cap body, the conductive member limiting the moving member to move within the hole; and a conductive rod coupled to the moving member through the perforation hole of the conductive member and moving forward and backward together with the moving member, so that the conductive rod makes the conductive member electrically contact with the minus electrode of the battery accommodated in the conductive barrel in moving forward, and breaks the conductive member electrically contact with the minus electrode of the battery in moving backward.

17. The flashlight as claimed in claim 1, wherein the conductive barrel has a perforation hole formed at an outer sidewall of the front end and a push button switch installed in the conductive barrel, a knob of the push button switch being exposed to an exterior through the perforation hole, and an elastic member being installed in the perforation hole so as to cover the knob.

18. The flashlight as claimed in claim 17, wherein the push button switch includes a cylindrical insulation case accommodated in the conductive barrel and divided into two semi-cylindrical parts along an axial direction thereof;

a spring protruded from a front surface of the insulation case and fixed thereto, to thereby electrically make contact with the metal layer of the lamp module;

a plus conductor fixed to a rear surface of the insulation case, to thereby to electrically make contact with the plus electrode of the battery; and a switch fixed to a lateral portion of the insulation case such that the knob is protruded through the perforation hole and has a first terminal electrically connected to a rear end of the spring and a second terminal electrically connected to the plus conductor for performing a switching action.

19. The flashlight as claimed in claim 18, wherein the conductive barrel has a length longer than a length of three batteries aligned in series.

* * * * *